US011092042B2

(12) United States Patent
McCarthy, Jr. et al.

(10) Patent No.: US 11,092,042 B2
(45) Date of Patent: Aug. 17, 2021

(54) ROCKER ARM ASSEMBLY WITH VALVE BRIDGE

(71) Applicant: Eaton Intelligent Power Limited, Dublin (IE)

(72) Inventors: James E. McCarthy, Jr., Kalamazoo, MI (US); Douglas J. Nielsen, Marshall, MI (US); Mark VanWingerden, Battle Creek, MI (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/792,521

(22) Filed: Feb. 17, 2020

(65) Prior Publication Data

US 2020/0182098 A1 Jun. 11, 2020

Related U.S. Application Data

(63) Continuation-in-part of application No. 16/195,120, filed on Nov. 19, 2018, now Pat. No. 10,690,024, (Continued)

(30) Foreign Application Priority Data

| | | |
|---|---|---|
| Mar. 16, 2016 | (IN) | 201611009132 |
| Apr. 7, 2016 | (IN) | 201611012287 |
| Apr. 28, 2016 | (IN) | 201611014772 |

(51) Int. Cl.

| | |
|---|---|
| ***F01L 1/18*** | (2006.01) |
| ***F01L 1/24*** | (2006.01) |
| *F01L 13/06* | (2006.01) |

(52) U.S. Cl.
CPC ..... *F01L 1/182* (2013.01); *F01L 1/2416* (2013.01); *F01L 13/06* (2013.01)

(58) Field of Classification Search
CPC ..... F01L 1/182; F01L 1/2416; F01L 13/06; F01L 1/24; F01L 1/26; F01L 1/18; F01L 2001/186
See application file for complete search history.

(56) References Cited

U.S. PATENT DOCUMENTS 5,353,756 A 10/1994 Murata et al.
5,495,838 A 3/1996 Johnson, Jr.
(Continued)

FOREIGN PATENT DOCUMENTS

CN 101769186 A 7/2010
CN 102459830 A 5/2012
(Continued)

OTHER PUBLICATIONS

Chinese Office Action for CN Application No. 2016101045225 dated Mar. 21, 2019.
(Continued)

*Primary Examiner* — Zelalem Eshete
(74) *Attorney, Agent, or Firm* — RMCK Law Group PLC

(57) ABSTRACT

A rocker arm assembly selectively opening first and second engine valves. The assembly includes a rocker arm and a valve bridge operably associated with the rocker arm and including a main body and a lever rotatably coupled to the main body. The main body is configured to engage the first engine valve, and the lever is configured to engage the second engine valve.

18 Claims, 14 Drawing Sheets

Related U.S. Application Data which is a continuation of application No. PCT/US2016/013992, filed on Jan. 20, 2016, application No. 16/792,521, which is a continuation-in-part of application No. 16/130,496, filed on Sep. 13, 2018, now Pat. No. 10,626,758, which is a continuation of application No. PCT/US2016/069452, filed on Dec. 30, 2016, application No. 16/792,521, which is a continuation-in-part of application No. 16/154,184, filed on Oct. 8, 2018, now Pat. No. 10,927,724, which is a continuation of application No. PCT/US2017/026541, filed on Apr. 7, 2017.

(60) Provisional application No. 62/106,203, filed on Nov. 21, 2015, provisional application No. 62/280,652, filed on Jan. 19, 2016, provisional application No. 62/430,102, filed on Dec. 5, 2016.

(56) References Cited

U.S. PATENT DOCUMENTS

| | | | | |
|---|---|---|---|---|
| 5,806,477 | A | 9/1998 | Regueiro | |
| 5,975,251 | A | 11/1999 | McCarthy | |
| 5,992,376 | A | 11/1999 | Okada et al. | |
| 6,234,143 | B1 * | 5/2001 | Bartel | F01L 13/06 123/321 |
| 6,253,730 | B1 | 7/2001 | Gustafson | |
| 8,800,520 | B2 | 8/2014 | D'Amore | |
| 9,016,249 | B2 | 4/2015 | Roberts et al. | |
| 2005/0211206 | A1 | 9/2005 | Ruggiero et al. | |
| 2008/0072857 | A1 | 3/2008 | Sailer et al. | |
| 2010/0319657 | A1 | 12/2010 | Dodi et al. | |
| 2011/0067661 | A1 | 3/2011 | Schwoerer | |
| 2011/0079195 | A1 | 4/2011 | Dilly | |
| 2011/0220062 | A1 | 9/2011 | Sailer et al. | |
| 2012/0186546 | A1 | 7/2012 | Cecur et al. | |
| 2014/0130774 | A1 | 5/2014 | Forestier et al. | |
| 2015/0144096 | A1 | 5/2015 | Meneely et al. | |
| 2015/0159520 | A1 | 6/2015 | Cecur | |
| 2015/0354418 | A1 | 12/2015 | Jo et al. | |
| 2017/0016358 | A1 | 1/2017 | Yoon | |
| 2017/0175597 | A1 | 6/2017 | Cecur | |
| 2017/0321576 | A1 | 11/2017 | Nielsen | |

FOREIGN PATENT DOCUMENTS

| | | | |
|---|---|---|---|
| CN | 102472124 | A | 5/2012 |
| CN | 102650224 | A | 8/2012 |
| CN | 102840005 | A | 12/2012 |
| CN | 203271844 | U | 11/2013 |
| CN | 205779084 | U | 12/2016 |
| CN | 107100693 | A | 8/2017 |
| GB | 2443419 | A | 5/2008 |
| WO | 2014001560 | A1 | 1/2014 |
| WO | 2015191663 | A1 | 12/2015 |

OTHER PUBLICATIONS

European Search Report for EP Application No. 16 74 0621 dated Aug. 13, 2018, 8 pages.

International Search Report and Written Opinion for International Application No. PCT/US2016/013992 dated May 25, 2016, 10 pages.

International Search Report and Written Opinion for International Application No. PCT/US2017/026541 dated Jul. 20, 2017, 17 pages.

Japanese Office Action for JP Application No. 2017-538366 dated Sep. 17, 2019 with English translation.

* cited by examiner

ROCKER ARM ASSEMBLY WITH VALVE BRIDGE

CROSS-REFERENCE TO RELATED APPLICATIONS

This application is a continuation-in-part of U.S. patent application Ser. No. 16/195,120 filed on Nov. 19, 2019, which claims the benefit of International Application No. PCT/US2016/013992 filed on Jan. 20, 2016; U.S. Patent Application No. 62/106,203 filed on Jan. 21, 2015; U.S. Patent Application No. 62/280,652 filed on Jan. 19, 2016; and U.S. Patent Application No. 62/587,852 filed on Nov. 17, 2017. The disclosures of the above applications are incorporated herein by reference.

This application is also a continuation-in-part of U.S. patent application Ser. No. 16/130,496 filed on Sep. 13, 2018, which claims the benefit of International Application No. PCT/US2016/069452 filed on Dec. 30, 2016; Indian Patent App. No. 201611009132 filed on Mar. 16, 2016; and Indian Patent App. No. 201611014772 filed on Apr. 28, 2016.

This application is also a continuation-in-part of U.S. patent application Ser. No. 16/154,184 filed on Oct. 8, 2018, which claims the benefit of International Application No. PCT/US2017/026541 filed on Apr. 7, 2017; U.S. Pat. App. No. 62/430,102 filed on Dec. 5, 2016; U.S. Pat. App. No. 62/568,852 filed on Oct. 6, 2017; Indian Patent App. No. 201611012287 filed on Apr. 7, 2016; and Indian Patent Application No. 201611014772 filed on Apr. 28, 2016.

FIELD

The present disclosure relates generally to a rocker arm assembly for use in a valve train assembly and, more particularly, to a rocker arm assembly having a valve bridge.

BACKGROUND

Compression engine brakes can be used as auxiliary brakes in addition to wheel brakes, for example, on relatively large vehicles powered by heavy or medium duty diesel engines. A compression engine braking system is arranged, when activated, to provide an additional opening of an engine cylinder's exhaust valve when the piston in that cylinder is near a top-dead-center position of its compression stroke so that compressed air can be released through the exhaust valve. This causes the engine to function as a power consuming air compressor which slows the vehicle.

In a typical valve train assembly used with a compression engine brake, the exhaust valve is actuated by a rocker arm which engages the exhaust valve by means of a valve bridge. The rocker arm rocks in response to a cam on a rotating cam shaft and presses down on the valve bridge which itself presses down on the exhaust valve to open it. A hydraulic lash adjuster may also be provided in the valve train assembly to remove any lash or gap that develops between the components in the valve train assembly.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

In one aspect of the present disclosure, an exhaust valve rocker arm assembly selectively opening first and second exhaust valves is provided. The assembly includes an exhaust rocker arm, and a valve bridge operably associated with the rocker arm and including a main body and a lever rotatably coupled to the main body, the main body configured to engage the first exhaust valve, and the lever configured to engage the second exhaust valve. A brake rocker arm is configured to selectively engage and rotate the lever to open the second exhaust valve, and the brake rocker arm is coupled to the lever and configured to maintain constant contact therewith for dynamic stability.

In addition to the foregoing, the exhaust valve rocker arm assembly may include one or more of the following features: wherein the brake rocker arm includes an actuator coupled to the lever to maintain the constant contact therewith; wherein the actuator includes a socket, wherein the socket is coupled to the lever to maintain the constant contact therewith; wherein the actuator is a piston assembly; wherein the actuator is a brake capsule assembly; wherein the lever is coupled to the main body such that rotation of the lever and engagement of the second exhaust valve occurs without rotation of the main body; wherein the main body includes an aperture, the lever at least partially disposed within the aperture; and wherein the lever is rotatably coupled to the main body by a bridge pin extending through the main body.

In addition to the foregoing, the exhaust valve rocker arm assembly may include one or more of the following features: wherein the lever includes an engagement surface, an opposed side opposite the engagement surface, and a stop flange extending therefrom, wherein the engagement surface is configured to be engaged by an engine brake rocker arm, the opposed side is configured to move upwardly against the main body when the engagement surface is moved downward, and wherein the stop flange is configured to selectively engage an edge of the main body that at least partially defines the aperture to limit downward movement of the lever.

In addition to the foregoing, the exhaust valve rocker arm assembly may include one or more of the following features: a valve shoe rotatably coupled to the lever, the valve shoe configured to engage the second exhaust valve; wherein the valve shoe is rotatably coupled to the lever by a valve shoe pin extending through the lever; a hydraulic lash adjuster assembly coupled between the exhaust rocker arm and the valve bridge; wherein the actuator assembly is movable between a retracted position and an extended position; wherein the actuator assembly includes a first piston body, a second piston body disposed within the first piston body, and a socket coupled between the first piston body and the lever, the socket configured to engage the lever; and a hydraulic lash adjuster assembly coupled between the exhaust rocker arm and the valve bridge, and a cylinder deactivation (CDA) capsule disposed in the exhaust rocker arm and configured to move between an activated position and a deactivated position.

In another aspect of the present disclosure, an exhaust valve rocker arm assembly selectively opening first and second exhaust valves is provided. The assembly includes an exhaust rocker arm, and a valve bridge operably associated with the rocker arm and including a main body and a lever rotatably coupled to the main body, the main body configured to engage the first exhaust valve, and the lever configured to engage the second exhaust valve. An engine brake rocker arm is configured to selectively rotate the lever to open the second exhaust valve, and the engine brake rocker arm includes a socket coupled to the lever to maintain constant contact for dynamic stability.

In another aspect of the present disclosure, an exhaust valve rocker arm assembly selectively opening first and second exhaust valves is provided. The assembly includes an exhaust rocker arm, and a valve bridge operably associated with the rocker arm and including a main body and a lever rotatably coupled to the main body, the main body configured to engage the first exhaust valve, and the lever configured to engage the second exhaust valve. A hydraulic lash adjuster (HLA) assembly is coupled between the exhaust rocker arm and the valve bridge. The exhaust rocker arm contacts the main body and defines a central point of contact, and the main body defines an axial length. The lever is rotatably coupled to the main body at a pivot point, which is located at a predetermined distance from the central point of contact along the main body axial length. The predetermined distance is determined by at least one of forces on the exhaust rocker arm and the HLA assembly.

In addition to the foregoing, the exhaust valve rocker arm assembly may include one or more of the following features: an engine brake rocker arm assembly having an engine brake rocker arm configured to selectively engage and rotate the lever to open the second exhaust valve, wherein the predetermined distance is determined by at least one of forces on the exhaust rocker arm, the HLA assembly, and the engine brake rocker arm.

In another aspect of the present disclosure, an intake valve rocker arm assembly selectively opening first and second exhaust valves is provided. The assembly includes a first intake rocker arm, and a valve bridge operably associated with the first intake rocker arm and including a main body and a lever rotatably coupled to the main body, the main body configured to engage the first intake valve, and the lever configured to engage the second intake valve. A second intake rocker arm is configured to selectively engage and rotate the lever to open the second intake valve.

In addition to the foregoing, the intake valve rocker arm assembly may include one or more of the following features: wherein the second intake rocker arm is coupled to the lever and configured to maintain constant contact therewith for dynamic stability; wherein the second intake rocker arm is configured to selectively engage and rotate the lever to open the second intake valve and perform a late intake valve closing (LIVC), and wherein the first intake rocker arm includes a cylinder deactivation (CDA) capsule configured to move between an activated position and a deactivated position.

In addition to the foregoing, the intake valve rocker arm assembly may include one or more of the following features: wherein in the activated position, the CDA capsule acts as a unitary body and transfers motion to the valve bridge, and wherein in the deactivated position, the CDA capsule is configured to collapse and absorb motion of the first intake rocker arm without transferring the motion to the valve bridge; wherein the CDA capsule is hydraulically actuated between the activated position and the deactivated position; a hydraulic lash adjuster (HLA) assembly coupled between the first intake rocker arm and the valve bridge; and wherein the CDA capsule is in-line with the HLA assembly.

In another aspect of the present disclosure, an exhaust valve rocker arm assembly selectively opening first and second exhaust valves is provided. The assembly includes an exhaust rocker arm, and a valve bridge operably associated with the rocker arm and including a main body and a lever rotatably coupled to the main body, the main body configured to engage the first exhaust valve, and the lever configured to engage the second exhaust valve. The lever is configured to engage the second exhaust valve to perform at least one of an internal exhaust gas recirculation (IEGR) event and an early exhaust valve opening (EEVO) event.

In another aspect of the present disclosure, an exhaust valve rocker arm assembly selectively opening first and second exhaust valves is provided. The assembly includes an exhaust rocker arm, and a valve bridge operably associated with the rocker arm and including a main body and a lever rotatably coupled to the main body, the main body configured to engage the first exhaust valve, and the lever configured to engage the second exhaust valve. The exhaust rocker arm includes a cylinder deactivation (CDA) capsule configured to move between an activated position and a deactivated position.

In addition to the foregoing, the exhaust valve rocker arm assembly may include one or more of the following features: wherein in the activated position, the CDA capsule acts as a unitary body and transfers motion to the valve bridge, and wherein in the deactivated position, the CDA capsule is configured to collapse and absorb motion of the exhaust rocker arm without transferring the motion to the valve bridge; wherein the CDA capsule is hydraulically actuated between the activated position and the deactivated position; a hydraulic lash adjuster (HLA) assembly coupled between the exhaust rocker arm and the valve bridge; and wherein the CDA capsule is in-line with the HLA assembly.

In another aspect of the present disclosure, an exhaust valve rocker arm assembly selectively opening first and second exhaust valves is provided. The assembly includes an exhaust rocker arm, and a valve bridge operably associated with the rocker arm and including a main body and a first lever rotatably coupled to the main body, the main body configured to engage the first exhaust valve, and the first lever configured to engage the second exhaust valve. The valve bridge further includes a second lever rotatably coupled to the main body, the second lever configured to engage the first exhaust valve.

In addition to the foregoing, the exhaust valve rocker arm assembly may include one or more of the following features: wherein the second lever is configured to engage the first exhaust valve to perform at least one of an internal exhaust gas recirculation (IEGR) event and an early exhaust valve opening (EEVO) event.

In another aspect of the present disclosure, an exhaust valve rocker arm assembly selectively opening first and second exhaust valves is provided. The assembly includes an exhaust rocker arm, an engine brake rocker arm, an added function rocker arm, and a valve bridge including a main body, a first lever rotatably coupled to the main body, and a second lever rotatably coupled to the main body.

In addition to the foregoing, the exhaust valve rocker arm assembly may include one or more of the following features: wherein the main body is configured to engage the first and second exhaust valves; wherein the first lever is configured to engage the first exhaust valve; wherein the first lever engages the first exhaust valve to perform an engine braking operation; wherein the second lever is configured to engage the second exhaust valve; and wherein the second lever engages the second exhaust valve to perform at least one of an internal exhaust gas recirculation (IEGR) operation and an early exhaust valve opening (EEVO) operation.

In addition to the foregoing, the exhaust valve rocker arm assembly may include one or more of the following features: wherein the second lever is coupled to the main body such that rotation of the second lever and engagement of the second exhaust valve occurs without rotation of the main body; wherein the main body includes a first aperture and a second aperture, wherein the first lever is nested within the first aperture, and the second lever is nested within the second aperture; and wherein the first lever is rotatably coupled to the main body by a first bridge pin extending through the main body, and wherein the second lever is rotatably coupled to the main body by a second bridge pin extending through the main body.

In addition to the foregoing, the exhaust valve rocker arm assembly may include one or more of the following features: wherein each of the first and second levers includes an engagement surface, an opposed side opposite the engagement surface, and a stop flange extending therefrom, wherein the engagement surface is configured to be engaged by one of the engine brake rocker arm and the added function rocker arm, the opposed side is configured to move upwardly against the main body when the engagement surface is moved downward, and wherein the stop flange is configured to selectively engage an edge of the main body that at least partially defines the first or second aperture to limit downward movement of the first or second lever.

In addition to the foregoing, the exhaust valve rocker arm assembly may include one or more of the following features: a valve shoe rotatably coupled to each of the first and second levers, the valve shoe configured to engage one of the first and second exhaust valves; wherein the valve shoe is rotatably coupled to one of the first or second levers by a valve shoe pin extending through the one first and second lever; a hydraulic lash adjuster assembly coupled between the exhaust rocker arm and the valve bridge; and wherein the exhaust rocker arm includes a cylinder deactivation (CDA) capsule configured to move between an activated position and a deactivated position.

In addition to the foregoing, the exhaust valve rocker arm assembly may include one or more of the following features: wherein in the activated position, the CDA capsule acts as a unitary body and transfers motion to the valve bridge, and wherein in the deactivated position, the CDA capsule is configured to collapse and absorb motion of the exhaust rocker arm without transferring the motion to the valve bridge; wherein the CDA capsule is hydraulically actuated between the activated position and the deactivated position; a hydraulic lash adjuster (HLA) assembly coupled between the exhaust rocker arm and the valve bridge; and wherein the CDA capsule is in-line with the HLA assembly.

BRIEF DESCRIPTION OF THE DRAWINGS

The present disclosure will become more fully understood from the detailed description and the accompanying drawings, wherein.

DETAILED DESCRIPTION

Figure 1:
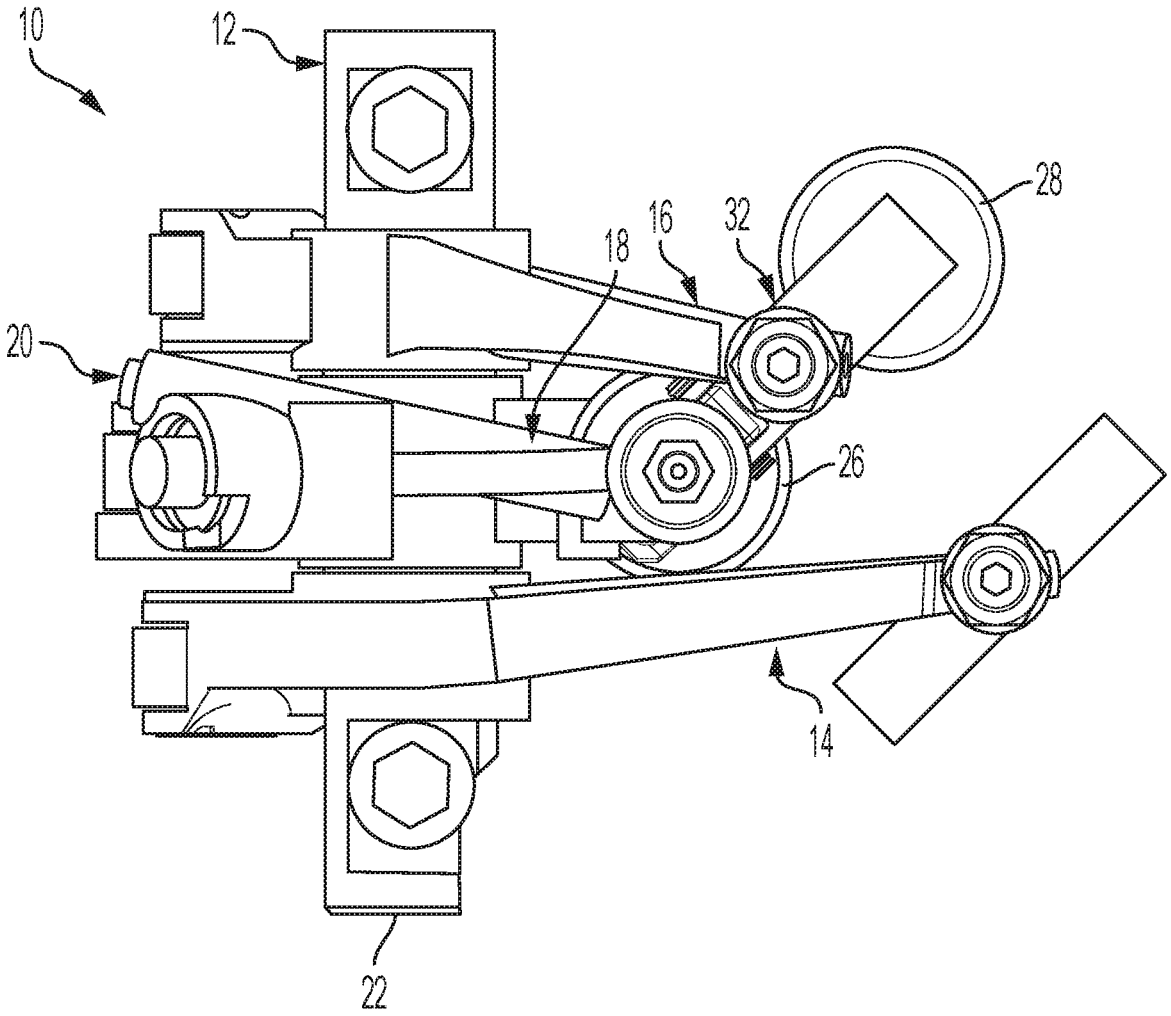
FIG. 1 is a plan view of a valve train assembly incorporating a rocker arm assembly that includes an intake rocker arm assembly, an exhaust rocker arm assembly, and an engine brake rocker arm assembly constructed in accordance to one example of the present disclosure.
Figure 2:
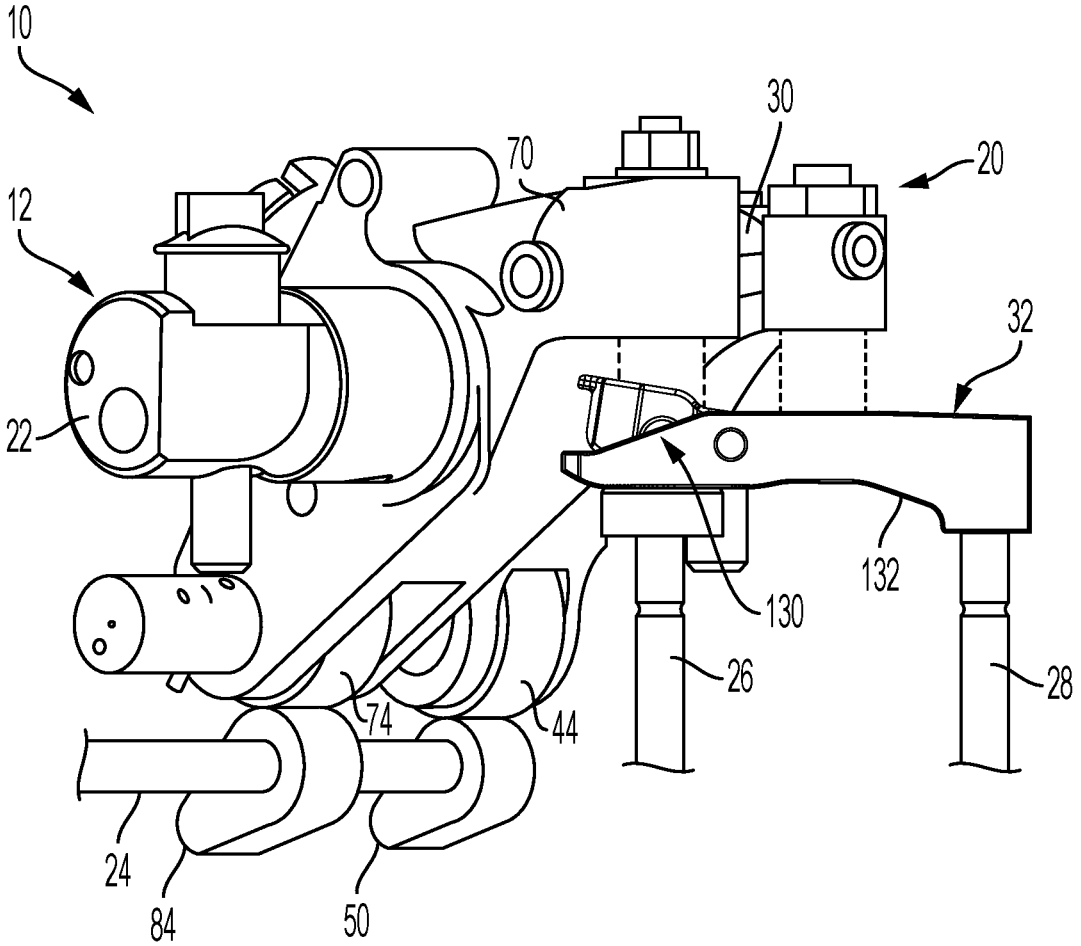
FIG. 2 is a perspective view of the valve train assembly shown in FIG. 1 without the intake rocker arm assembly.

With initial reference to FIGS. 1 and 2, a partial valve train assembly constructed in accordance to one example of the present disclosure is shown and generally identified at reference 10. The partial valve train assembly 10 utilizes engine braking and is shown configured for use in a three-cylinder bank portion of a six-cylinder engine. It will be appreciated however that the present teachings are not so limited. In this regard, the present disclosure may be used in any valve train assembly that utilizes engine braking. The partial valve train assembly 10 is supported in a valve train carrier 12 and can include three rocker arms per cylinder.

Specifically, each cylinder includes an intake valve rocker arm assembly 14, an exhaust valve rocker arm assembly 16, and an engine brake rocker arm assembly 18. The exhaust valve rocker arm assembly 16 and the engine brake rocker arm assembly 18 cooperate to control opening of the exhaust valves and are collectively referred to as a dual rocker arm assembly 20 (FIG. 2). The intake valve rocker arm assembly 14 is configured to control motion of the intake valves, the exhaust valve rocker arm assembly 16 is configured to control exhaust valve motion in a drive mode, and the engine brake rocker arm assembly 18 is configured to act on one of the two exhaust valves in an engine brake mode, as will be described herein.

A rocker shaft 22 is received by the valve train carrier 12 and supports rotation of the exhaust valve rocker arm assembly 16 and the engine brake rocker arm assembly 18. As described herein in more detail, the rocker shaft 22 can communicate oil to the assemblies 16, 18 during operation. A cam shaft 24 includes lift profiles or cam lobes configured to rotate assemblies 16, 18 to activate first and second exhaust valves 26 and 28, as is described herein in more detail.

Figure 3:
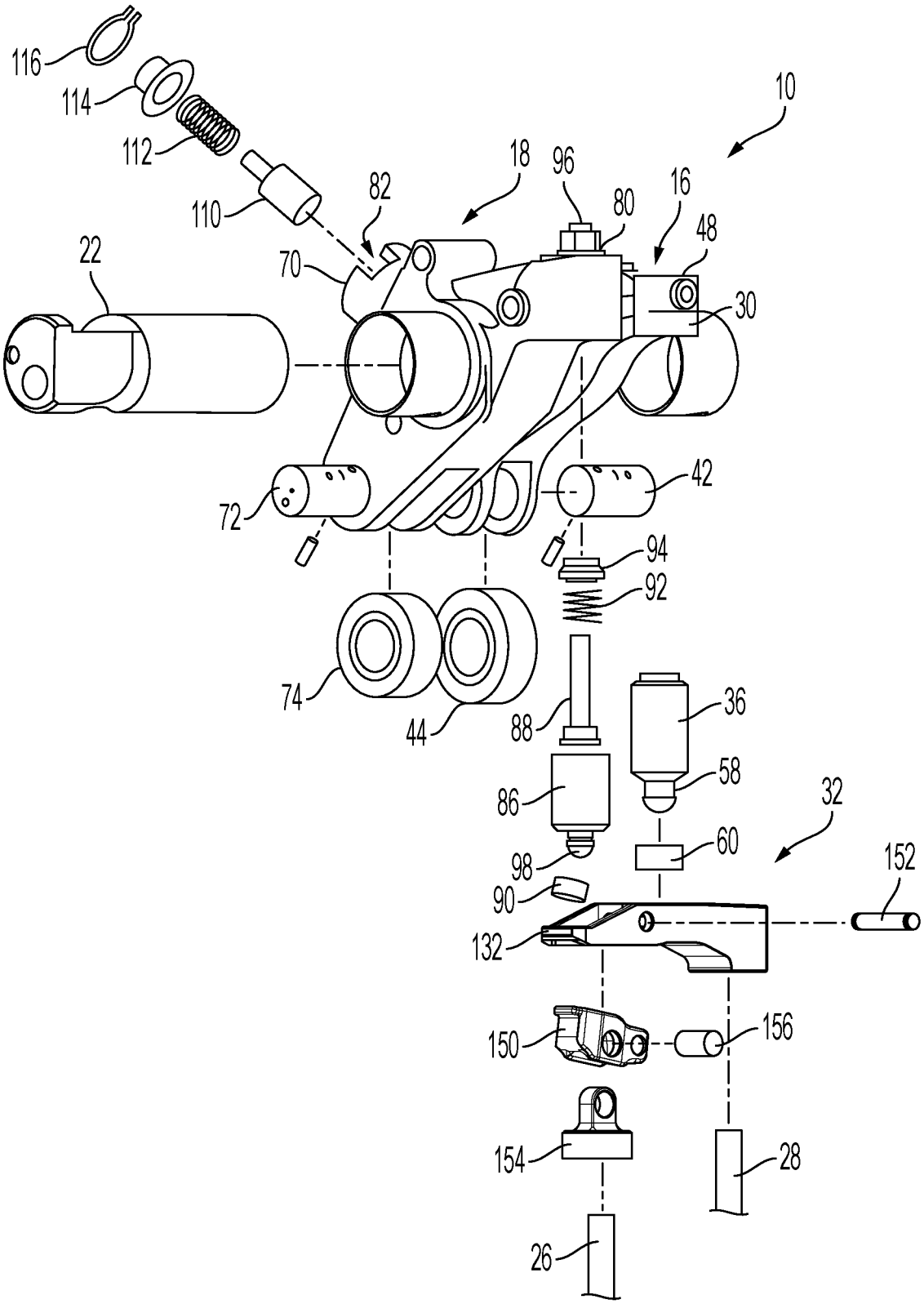
FIG. 3 is an exploded view of the exhaust valve rocker arm assembly and the engine brake rocker arm assembly of FIG. 1.

With further reference now to FIGS. 2 and 3, exhaust valve rocker arm assembly 16 will be further described. The exhaust valve rocker arm assembly 16 can generally include an exhaust rocker arm 30, a valve bridge assembly 32, and a hydraulic lash adjuster (HLA) assembly 36.

The exhaust rocker arm 30 includes a body 40, an axle 42, and a roller 44. Body 40 can receive the rocker shaft 22 and defines a bore 48 configured to at least partially receive the HLA assembly 36. The axle 42 can be coupled to the body 40 and can receive the roller 44, which is configured to be engaged by an exhaust lift profile or cam lobe 50 (FIG. 2) of the cam shaft 24. As such, when roller 44 is engaged by the exhaust lift profile 50, the exhaust rocker arm 30 is rotated downward, causing downward movement of the valve bridge assembly 32, which engages the first and second exhaust valve 26 and 28 (FIG. 2) associated with a cylinder of an engine (not shown).

The HLA assembly 36 is configured to take up any lash between the HLA assembly 36 and the valve bridge assembly 32. With additional reference to FIGS. 8 and 9, in one exemplary implementation, the HLA assembly 36 can comprise a plunger assembly 52 including a leak down plunger or first plunger body 54 and a ball plunger or second plunger body 56. The plunger assembly 52 is received by bore 48 defined in rocker arm 30, and can have a first closed end defining a spigot 58, which is received in a socket 60 that acts against the valve bridge assembly 32. The second plunger body 56 has an opening that defines a valve seat 62, and a check ball assembly 64 can be positioned between the first and second plunger bodies 54, 56.

Figure 8:
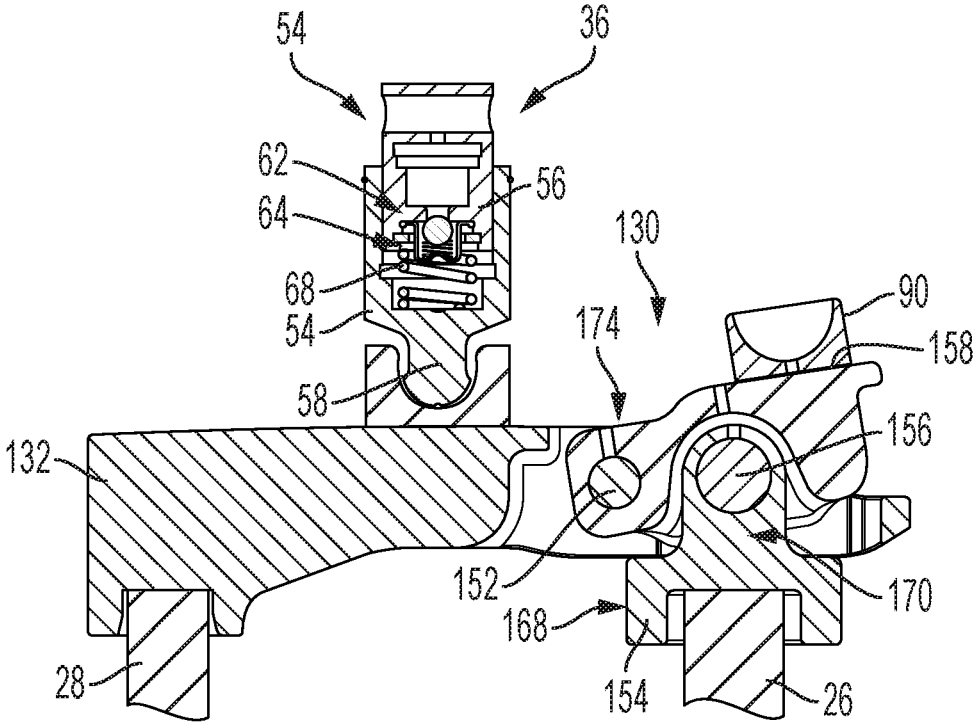
FIG. 8 is a cross-sectional view of the rocker arm assembly shown in FIG. 5 taken along line 8-8 and during a normal exhaust event actuation.
Figure 9:
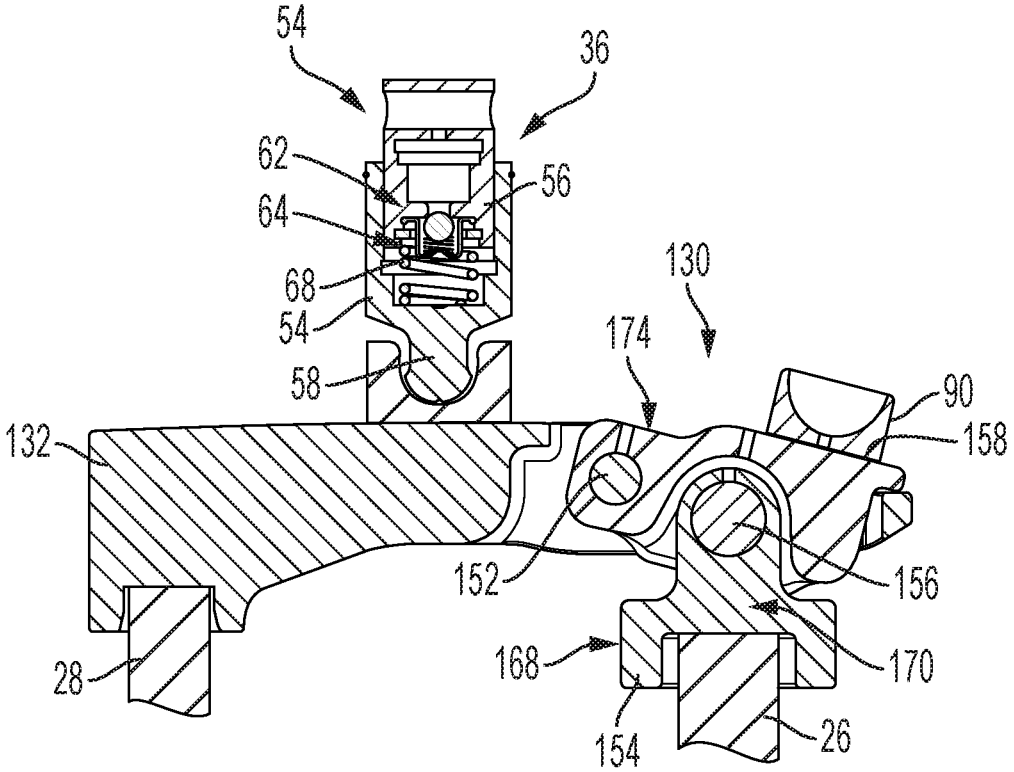
FIG. 9 is a cross-sectional view of the rocker arm assembly shown in FIG. 5 taken along line 8-8 and during a brake event actuation.

The check ball assembly 64 can be configured to hold oil within a chamber 66 between the first and second plunger bodies 54, 56. A biasing mechanism 68 (e.g., a spring) biases second plunger body 56 upward (as shown in FIGS. 8 and 9) to expand the first plunger body 54 to take up any lash. As second plunger body 56 is biased upward, oil is drawn through check ball assembly 64 and into the chamber 66 between plunger bodies 54, 56. Accordingly, oil can be supplied from rocker shaft 22 through a channel (not shown) to the chamber within second plunger 56, and downward pressure can cause downward movement of the first plunger body 54 due to the oil in the chamber 66. However, HLA assembly 36 may have any other suitable configuration that enables assembly 36 to take up lash between the assembly and the valve bridge assembly 32.

Figure 4:
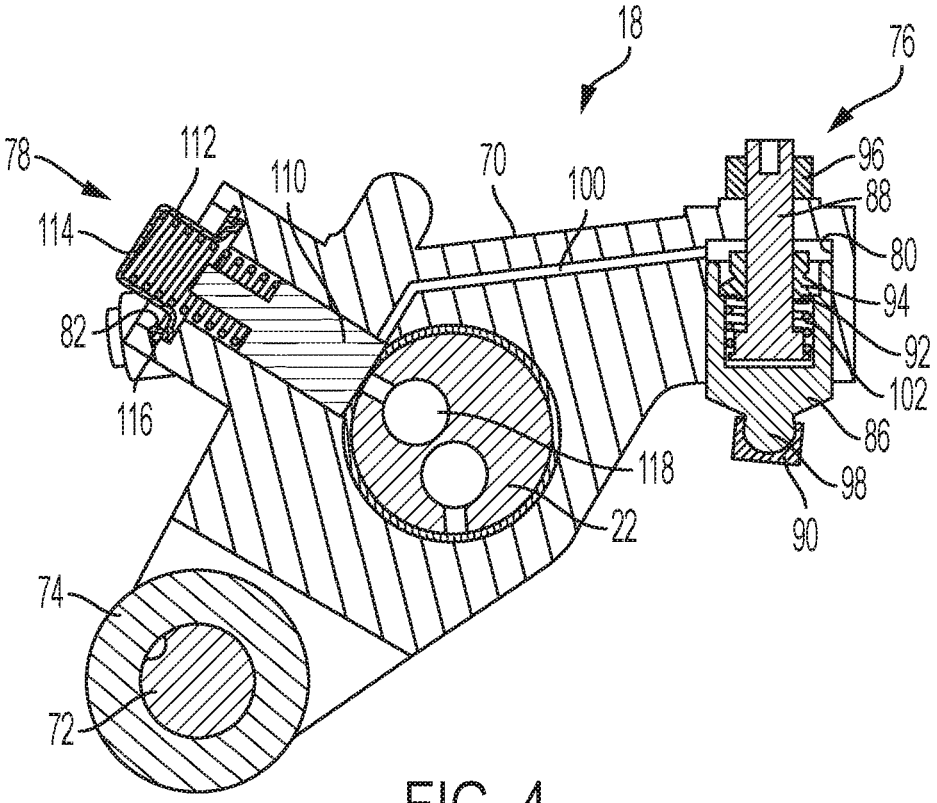
FIG. 4 is a cross-sectional view of the engine brake rocker arm assembly shown in FIG. 3 and taken along line 4-4.

With further reference now to FIGS. 2-4, engine brake rocker arm assembly 18 will be further described. The engine brake rocker arm assembly 18 can generally include an engine brake rocker arm 70, an axle 72, a roller 74, an actuator or piston assembly 76, and a check valve assembly 78.

Engine brake rocker arm 70 can receive the rocker shaft 22 and can define a first bore 80 and a second bore 82. The first bore 80 can be configured to at least partially receive the piston assembly 76, and the second bore 82 can be configured to at least partially receive the check valve assembly 78. The axle 72 can be coupled to the rocker arm 70 and can receive the roller 74, which is configured to be engaged by a brake lift profile or cam lobe 84 (FIG. 2) of the cam shaft 24. As such, when the roller 74 is engaged by the cam lobe 84, the brake rocker arm 70 is rotated downward, causing downward movement of the piston assembly 76.

As shown in FIGS. 3 and 4, the actuator or piston assembly 76 can include a first actuator or piston body 86, a second actuator or piston body 88, a socket 90, a biasing mechanism 92, a stopper 94, and a nut 96. The piston assembly 76 can be received by the first bore 80 of the rocker arm 70. The first piston body 86 can include a first closed end that defines a spigot 98, which is received in socket 90 that acts against the valve bridge assembly 32. The second piston body 88 can be secured to rocker arm 70 by nut 96, and stopper 94 can be secured to the second piston body 88. The second piston body 88 and the nut 96 can act as a fine adjustment screw to set the initial position of piston assembly 76.

The biasing mechanism 92 (e.g., a spring) is configured to draw or retract the first piston body 86 upward into the bore 80 to a retracted position. The stopper 94 can be configured to limit upward movement of the first piston body 86. Pressurized oil is selectively supplied through a channel 100 (FIG. 4) to a chamber 102 of the first piston body 86 to move the piston body 86 downward and outward from the bore 80 to an extended position. When the oil supply to channel 100 is suspended, the first piston body 86 returns to the retracted position by the biasing mechanism 92.

The check valve assembly 78 is at least partially disposed in the second bore 82 and can include a spool or check valve 110, a biasing mechanism 112, a cover 114, and a clip 116. The check valve assembly 78 is configured to selectively supply oil from a channel 118 (FIG. 4) in the rocker shaft 22 to the channel 100. The check valve 110 can be biased into a closed position by the biasing mechanism 112 such that oil is not supplied to channel 100. When the oil pressure in channel 118 is sufficient to open the check valve 110, the oil is supplied via the channel 100 to actuate the piston assembly 76 into the extended position. Clip 116 can nest in a radial groove provided in the second bore 82 to retain the check valve assembly 78 therein.

Many known engines with hydraulic valve lash adjustment have a single rocker arm that actuates two valves through a valve bridge across those valves. The engine brake bypasses the bridge and pushes on one of the valves, which cocks or angles the valve bridge, to open a single valve and blow down the cylinder. However, due to the cocked valve bridge, the HLA can react by extending to take up the lash created. This may be undesirable because, after the brake event, the extended HLA assembly can then hold the exhaust valves open with certain loss of compression and possibly piston-to-valve contact.

To overcome this potentially undesirable event, assembly 10 includes valve bridge assembly 32 having a movable lever assembly 130 integrated therein. The lever assembly 130 can pass some of the valve actuation force back to the HLA assembly 36 (via bridge 32), thereby preventing unintended extension of the HLA assembly during the braking event. Thus, lever assembly 130 allows the valve 26 to open during the engine braking operation without allowing downward motion of the valve bridge assembly 32. Moreover, lever assembly 130 significantly reduces the actuation force required for the braking event compared to known systems.

Figure 6:
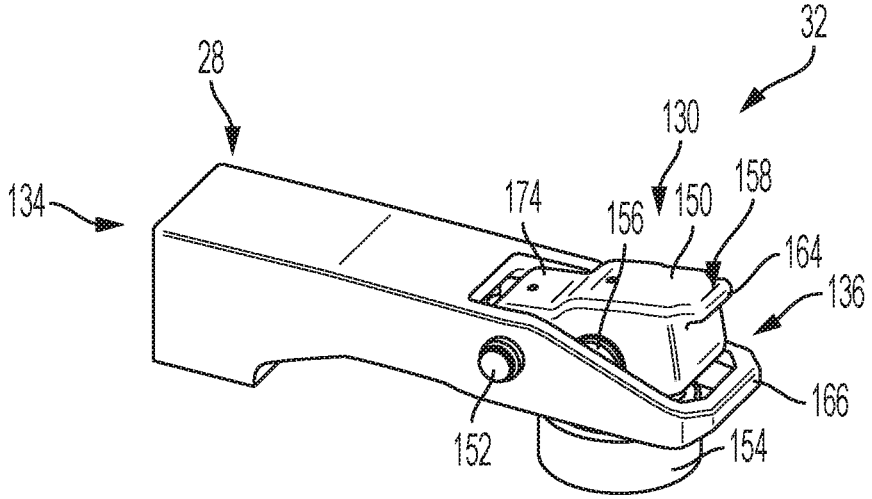
FIG. 6 is a perspective view of a valve bridge assembly of the exhaust valve rocker arm assembly shown in FIG. 1, constructed in accordance to one example of the present disclosure.
Figure 7:
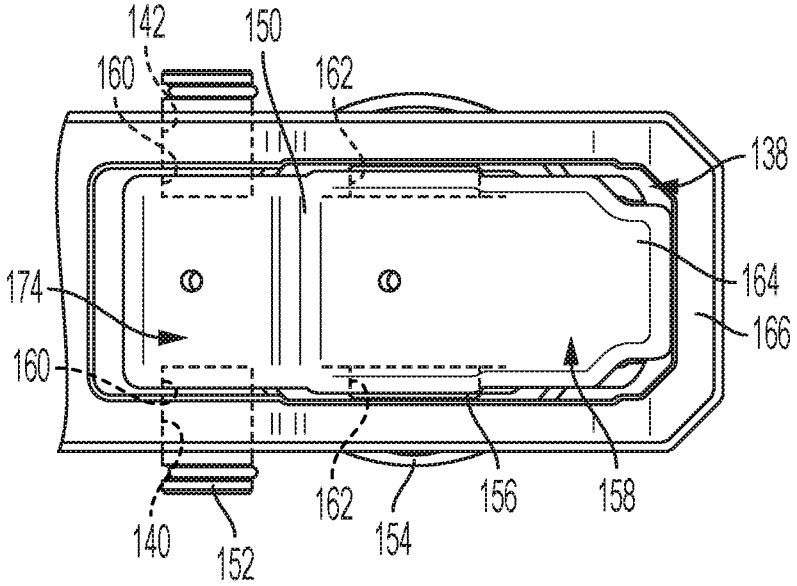
FIG. 7 is a plan view of a portion of the valve bridge assembly shown in FIG. 6.

With additional reference to FIGS. 6 and 7, in one exemplary implementation, the valve bridge assembly 32 comprises the lever assembly 130 disposed within a bridge main body 132. The bridge main body 132 includes a first end 134 and a second end 136. The first end 134 can be configured to engage valve 28, and the second end 136 can include a first aperture 138, a second aperture 140, and a third aperture 142.

Figure 5:
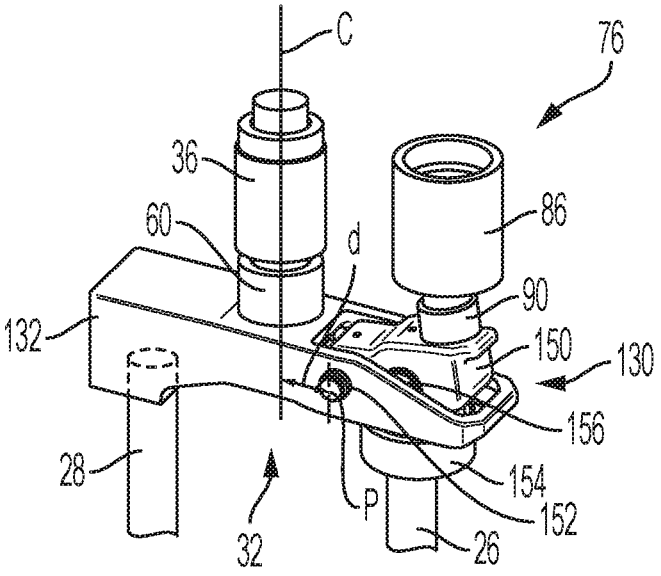
FIG. 5 is a perspective view of a portion of the rocker arm assembly shown in FIG. 1.

As shown in FIG. 5, the lever assembly 130 can generally include a lever 150, a bridge pin 152, a valve shoe 154, and a valve shoe pin 156. The lever 150 can be disposed within (e.g., nested within) the first aperture 138 and is rotatably coupled to the bridge main body 132 by the bridge pin 152, which extends through the second and third apertures 140, 142 of the bridge main body 132.

The lever 150 includes an engagement surface 158, first opposed openings 160, second opposed openings 162, and a stop flange 164. The engagement surface 158 is configured to be selectively engaged by socket 90 of piston assembly 76. In one example, the engine brake rocker arm 70 is coupled to the lever 150, for example, via the piston assembly 76 or socket 90, to maintain constant contact therebetween for dynamic stability to thereby prevent lever flutter (e.g., oscillation, vibration, etc.). First opposed openings 160 can receive the bridge pin 152, and the second opposed openings 162 can receive the valve shoe pin 156. The stop flange 164 can be configured to engage a bar 166 (FIGS. 6 and 7) of the bridge main body 132 to limit downward movement of the lever 150 (as shown in FIG. 6).

With continued reference to FIG. 5, lever 150 is rotatably coupled to the bridge main body 32 at a pivot point 'P' defined at least in part by the bridge pin 152. As illustrated, pivot point 'P' is located at a predetermined distance 'd' from a central point of contact 'C' of the HLA 36 along an entire width or axial length of the bridge main body 132. Distance 'd' from the central point of contact 'C' is variable based at least in part on one or more forces generated or experienced by the exhaust valve rocker arm assembly 16 (or intake valve rocker arm assembly 14 if on intake side), the engine brake rocker arm assembly 18, and/or the HLA assembly 36. For example, as the size of HLA assembly 36 is varied, distance 'd' is also varied to provide a lever or fulcrum geometry configured to apply a force on the HLA (when lever 150 is rotated) such that the HLA assembly 36 does not pump up or down.

The valve shoe 154 includes a main body portion 168 and a connecting portion 170 having an aperture 172 formed therein. The main body portion 168 is configured to receive a portion of the valve 26, and the connecting portion 170 is at least partially disposed within lever 150 such that the connecting portion aperture 172 receives the valve shoe pin 156 to rotatably couple the valve shoe 154 to the lever 150.

Accordingly, lever 150 can be selectively engaged at the engagement surface 158, which can cause rotation about pin 156 and upward movement of an opposed side 174 of the lever that is opposite surface 158 (see FIG. 9). This upward movement of lever end 174 causes upward movement of bridge main body 132 toward HLA assembly 36 to prevent extension thereof.

As such, during operation of rocker arm assembly 20, the exhaust rocker arm assembly 16 can selectively engage the valve bridge main body 132 to actuate valves 26, 28 and perform a normal exhaust event (combustion mode); whereas, the engine brake rocker arm assembly 18 can selectively engage the lever assembly 130 to only actuate valve 26 and perform a brake event actuation (engine braking mode).

The piston assembly 76 is configured to move the first piston body 86 between the retracted position and the extended position. In the retracted position, the first piston body 86 is withdrawn into the bore 80 such that the socket 90 is spaced apart from and does not contact the lever engagement surface 158 even when the cam lobe 84 of camshaft 24 engages the engine brake rocker arm 70.

However, in the extended position, the first piston body 86 extends from the bore 80 such that socket 90 is positioned to engage the lever engagement surface 158. When the cam lobe 84 of camshaft 24 engages the engine brake rocker arm 70, socket 90 rotates the lever about pin 156 to engage the valve 26 and perform the brake event actuation. FIG. 4 shows engine brake rocker arm assembly 18 with piston assembly 76 in the extended position as a result of oil being supplied from rocker shaft 22 through channel 100. In this position, engine brake event actuation is active, and piston assembly 76 is configured to engage the lever assembly 130 of the valve bridge assembly 32 (FIG. 9). The engine brake event actuation capability may be deactivated by ceasing the oil supply through channel 100 and/or 118, thereby causing the piston assembly 76 to move to the retracted position.

With reference now to FIGS. 4, 8 and 9, an exemplary operating sequence of the exhaust valve rocker arm assembly 16 and the engine brake rocker arm assembly 18 will be described.

FIG. 8 shows portions of assemblies 16, 18 during a normal exhaust event actuation where the exhaust rocker arm 30 is engaged by cam lobe 50 of cam shaft 24. In particular, as cam shaft 24 rotates, cam lobe 50 engages roller 44, which causes the exhaust rocker arm 30 to rotate about the rocker shaft 22. In this motion, the exhaust rocker arm 30 pushes through the HLA assembly 36 and moves the valve bridge main body 132 downward to open the first and second exhaust valves 26, 28.

FIG. 9 illustrates portions of assemblies 16, 18 during a brake event actuation where the engine brake rocker arm 70 is engaged by the cam lobe 84 of cam shaft 24. In particular, as cam shaft 24 rotates, cam lobe 84 engages roller 74, which causes the brake rocker arm 70 to rotate about the rocker shaft 22. When the first piston body 86 is in the extended position, the brake rocker arm 70 pushes socket 90 downward to engage and cause downward movement of lever engagement surface 158. This in turn can cause downward movement of the valve shoe 154, which opens valve 26 to brake the engine. Further, as lever 150 pivots about pin 156, lever end 174 moves upward against bridge main body 132, which pushes against the HLA assembly 36 to prevent extension thereof during the brake event.

In one alternative embodiment, instead of rocker arm assembly 18 operating in the engine brake mode, the rocker arm assembly 18 is configured to selectively operate in an Internal Exhaust Gas Recirculation (IEGR) mode. In the example embodiment, rocker arm assembly 18 pivots in response to a cam mounted on the camshaft 24 during intake lift of the engine cycle. The simultaneous opening of the intake and exhaust valves ensures that a certain amount of exhaust gas remains in the cylinder during combustion, which reduces NOx emissions. It will be appreciated that such switchable IEGR control may also be provided if the valve 26 is an intake valve with the timing to occur when an exhaust valve for that cylinder is open during the exhaust part of the engine cycle.

In another alternative embodiment, instead of rocker arm assembly 18 operating in the engine brake mode, the rocker arm assembly 18 is configured to selectively operate in an Early Exhaust Valve Opening (EEVO) mode. The rocker arm assembly 18 can include an EEVO capsule (not shown) selectively movable between an activated position and a deactivated position, for example, similar to actuator 76. In the example embodiment, rocker arm assembly 18 pivots in response to a cam mounted on the camshaft 24. The timing is such that rotation of rocker arm assembly 18 imparts motion to the exhaust valve 26 via the lever 150 at a timing to open the exhaust valve 26 earlier than that of a normal engine cycle.

Figure 10:
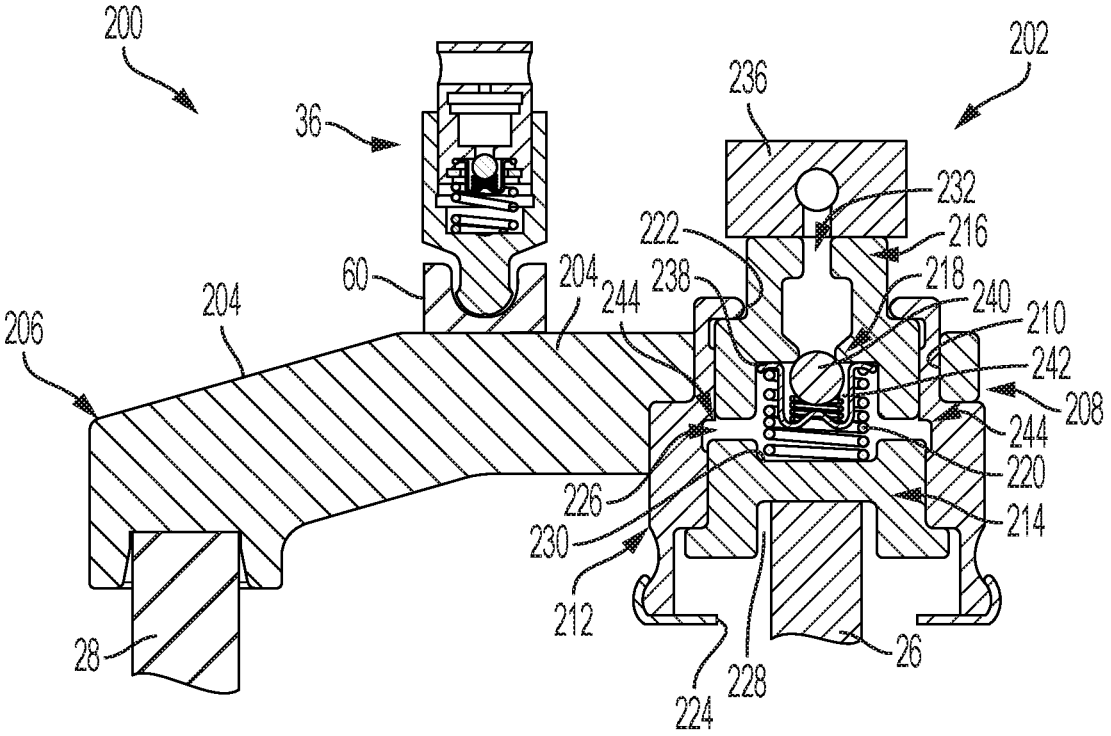
FIG. 10 is a cross-sectional view of another exhaust rocker arm assembly during a normal exhaust event actuation that may be used with the rocker arm assembly shown in FIG. 1, and constructed in accordance to one example of the present disclosure.
Figure 11:
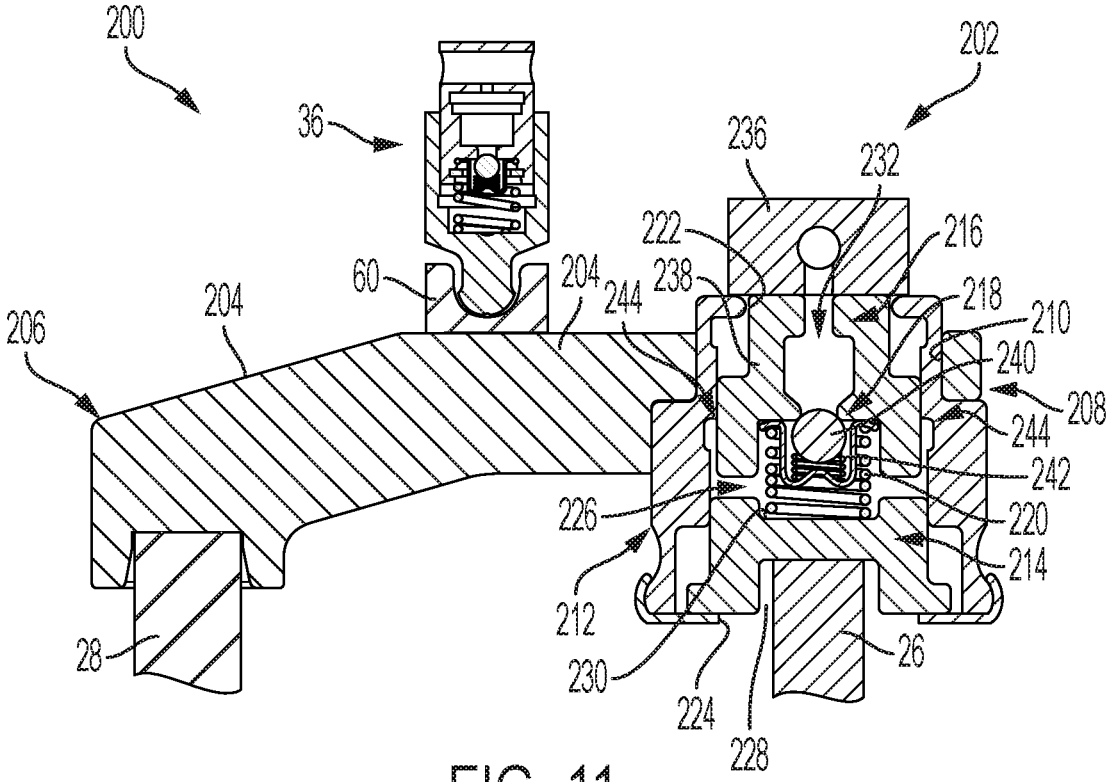
FIG. 11 is a cross-sectional view of the exhaust rocker arm assembly shown in FIG. 10 during a brake event actuation.

FIGS. 10 and 11 illustrate a valve bridge assembly 200 constructed in accordance to one example of the present disclosure. The valve bridge assembly 200 may be utilized with valve train assembly 10 and may be similar to valve bridge assembly 32 except that it can include a hydraulic actuator assembly 202 instead of the lever assembly 130. Accordingly, the valve bridge assembly 200 comprises the hydraulic actuator assembly 202 and a valve bridge main body 204, which includes a first end 206 and a second end 208. The first end 206 can be configured to engage valve 28, and the second end 208 can include an aperture 210.

The hydraulic actuator assembly 202 can be at least partially disposed within aperture 210 and can generally include a capsule or outer housing 212, a first actuator or piston body 214, a second actuator or piston body 216, a check ball assembly 218, and a biasing mechanism 220.

The outer housing 212 defines an upper aperture 222, a lower aperture 224, and a central chamber 226. At least a portion of the second piston body 216 extends through the upper aperture 222, and the lower aperture 224 is configured to receive at least a portion of the exhaust valve 26. The central chamber 226 defines a space between the first and second piston bodies 214, 216 that is configured to receive oil or other fluid from the brake rocker arm 70.

The first piston body 214 can be disposed within the outer housing 212 and can include a valve receiving slot 228 and a seat 230. The valve receiving slot 228 is configured to receive an end of the exhaust valve 26, and seat 230 can be configured for seating at least a portion of the biasing mechanism 220.

The second piston body 216 can be disposed at least partially within the outer housing 212 and can include an oil supply channel 232 and a check ball assembly seat 234. The oil supply channel 232 is fluidly connected to a capsule 236, which is coupled to the brake rocker arm 70 and configured to selectively receive a pressurized oil supply form the channel 118 of rocker shaft 22.

The check ball assembly 218 can be disposed at least partially within the check ball seat 234. The check ball assembly 218 can generally include a retainer 238, a check ball 240, and a biasing mechanism 242. The retainer 238 can be seated within seat 234 and is configured to maintain check ball 240 therein. The biasing mechanism 242 can bias the check ball against seat 234 to seal oil supply channel 232. As such, check ball assembly 218 is in the normally closed position. However, assembly 18 may be configured to have a normally open position.

The biasing mechanism 220 can have a first end seated in the seat 230 of the first piston 214, and a second end seated in the seat 234 of the second piston 216. The biasing mechanism 220 can be configured to bias the first and second pistons 214, 216 apart from each other, and can secure check ball assembly retainer 238 within seat 234. The biasing apart of first and second pistons 214, 216 can act to draw oil from channel 232 into central chamber 226 to assure oil is stored therein.

FIG. 10 shows portions of assemblies 16, 18 during a normal exhaust event actuation where the exhaust rocker arm 30 is engaged by cam lobe 50 of cam shaft 24 (see FIG. 2). In particular, as cam shaft 24 rotates, cam lobe 50 engages roller 44, which causes the exhaust rocker arm 30 to rotate about the rocker shaft 22. In this motion, the exhaust rocker arm 30 pushes through the HLA assembly 36 and moves the bridge main body 204 downward to open the first and second exhaust valves 26, 28.

FIG. 11 illustrates portions of assemblies 16, 18 during a brake event actuation where the engine brake rocker arm 70 is engaged by the cam lobe 84 of cam shaft 24 (see FIG. 2). In particular, as cam shaft 24 rotates, cam lobe 84 engages roller 74, which causes the brake rocker arm 70 to rotate about the rocker shaft 22. Pressurized oil is supplied through capsule 236 to oil supply chamber 232. The pressurized fluid and/or biasing mechanism 220 opens check ball assembly 218 such that oil fills the central chamber 226.

When the brake rocker arm 70 is engaged by the cam lobe 84, the rocker arm 70 can push capsule 236 downward to engage the second piston body 216, causing downward movement thereof. This downward movement of piston body 216 can force the fluid in central chamber 226 against the top of first piston body 214, causing downward movement thereof. This can force valve 26 downward to open and brake the engine. Additionally, the downward movement of piston body 216 can force the fluid in the central chamber 226 upward against an inner rim 244 of the outer housing 212. This causes upward movement of the outer housing 212, which provides enough upward force to the valve bridge main body 204 to prevent extension of the HLA assembly 36 during the brake event actuation.

Figure 12:
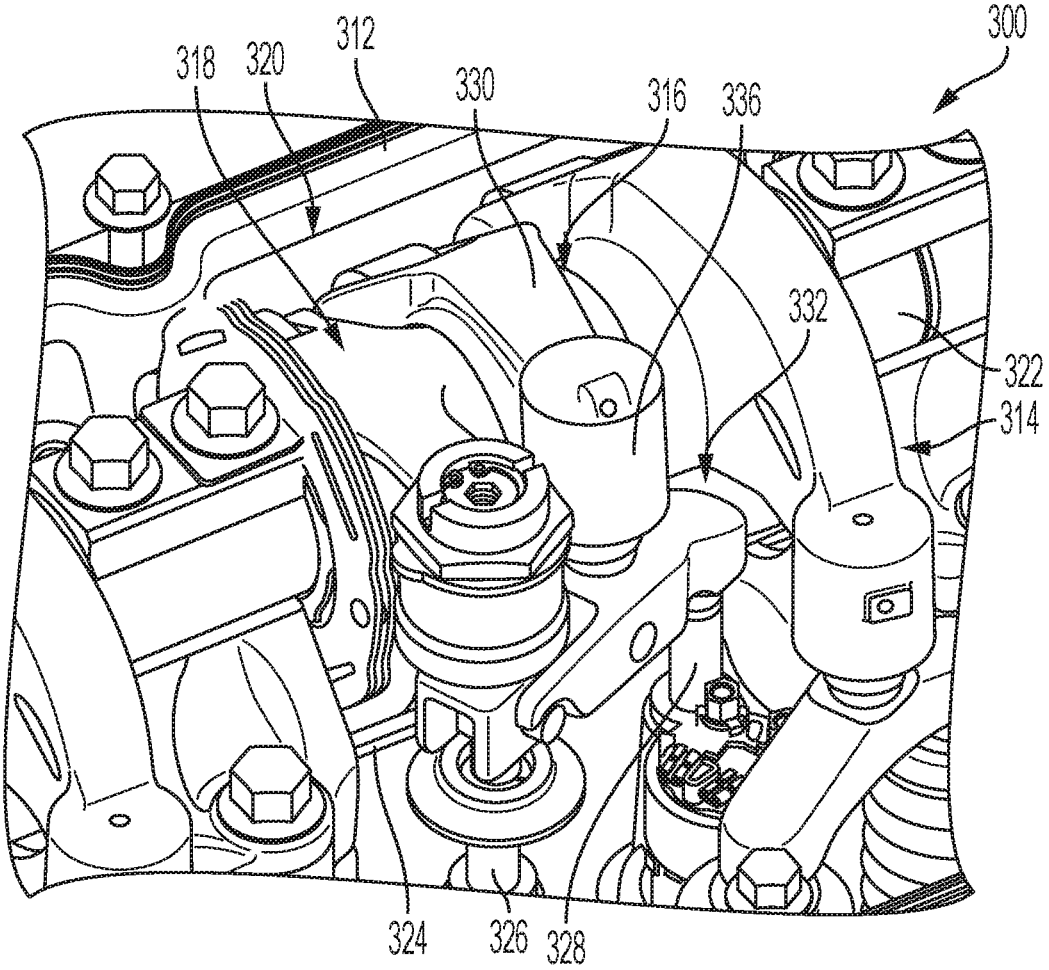
FIG. 12 is a perspective view of a valve train assembly incorporating a rocker arm assembly that includes an intake rocker arm assembly, an exhaust rocker arm assembly, and an engine brake rocker arm assembly constructed in accordance to another example of the present disclosure.
Figure 14:
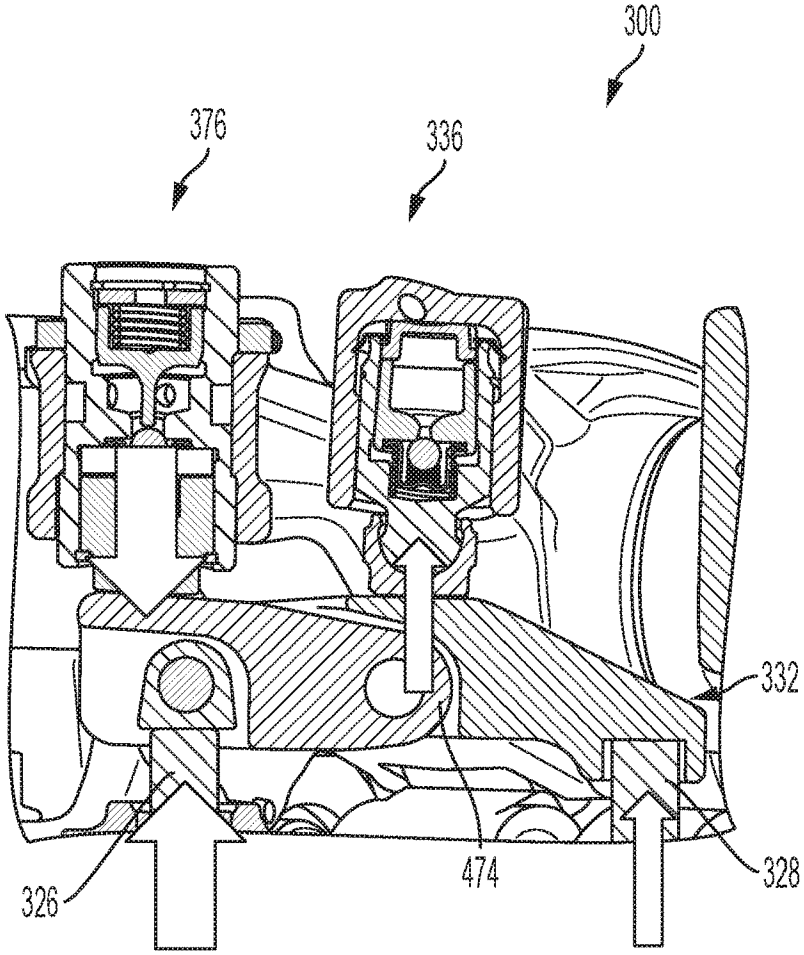
FIG. 14 is a sectional view of the valve train assembly shown in FIG. 12 in a second mode.
Figure 13:
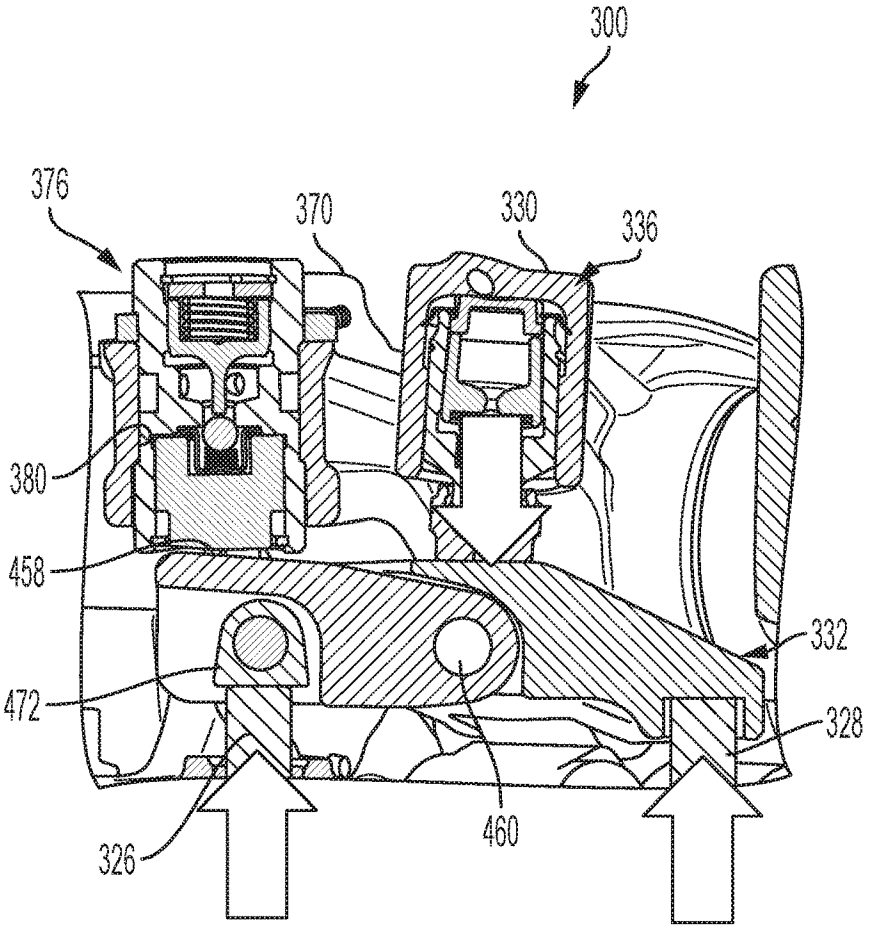
FIG. 13 is a sectional view of the valve train assembly shown in FIG. 12 in a first mode.

With reference to FIGS. 12-14, a partial valve train assembly constructed in accordance to another example of the present disclosure is shown and generally identified at reference 300. The partial valve train assembly 300 can be similar to the structure and function of partial valve train assembly 10 described herein. The partial valve train assembly 300 utilizes engine braking and is shown configured for use in a three-cylinder bank portion of a six-cylinder engine. It will be appreciated however that the present teachings are not so limited. In this regard, the present disclosure may be used in any valve train assembly that utilizes engine braking. The partial valve train assembly 300 is supported in a valve train carrier 312 and can include three rocker arms per cylinder.

Specifically, each cylinder includes an intake valve rocker arm assembly 314, an exhaust valve rocker arm assembly 316, and an engine brake rocker arm assembly 318. The exhaust valve rocker arm assembly 316 and the engine brake rocker arm assembly 318 cooperate to control opening of the exhaust valves and are collectively referred to as a dual rocker arm assembly 320. The intake valve rocker arm assembly 314 is configured to control motion of the intake valves, the exhaust valve rocker arm assembly 316 is configured to control exhaust valve motion in a drive mode, and the engine brake rocker arm assembly 318 is configured to act on one of the two exhaust valves in an engine brake mode, as will be described herein.

A rocker shaft 322 is received by the valve train carrier 312 and supports rotation of the exhaust valve rocker arm assembly 316 and the engine brake rocker arm assembly 318. As described herein in more detail, the rocker shaft 322 can communicate oil to the assemblies 316, 318 during operation. A cam shaft 324 includes lift profiles or cam lobes configured to rotate assemblies 316, 318 to activate first and second exhaust valves 326 and 328, as is described herein in more detail.

Exhaust valve rocker arm assembly 316 is similar to exhaust valve rocker arm assembly 16 and can generally include an exhaust rocker arm 330, a valve bridge assembly 332, and an HLA assembly 336, which can be similar to HLA assembly 36.

Engine brake rocker arm assembly 318 can generally include an engine brake rocker arm 370 and an engine brake capsule 376. The engine brake rocker arm 370 can receive the rocker shaft 322 and can define a bore 380 configured to at least partially receive the engine brake capsule 376. The rocker arm 370 is configured to be engaged by a brake lift profile or cam lobe (e.g., lobe 84) of the cam shaft 324 to rotate the brake rocker arm 370 downward, thereby causing downward movement of the engine brake capsule 376.

Figure 16:
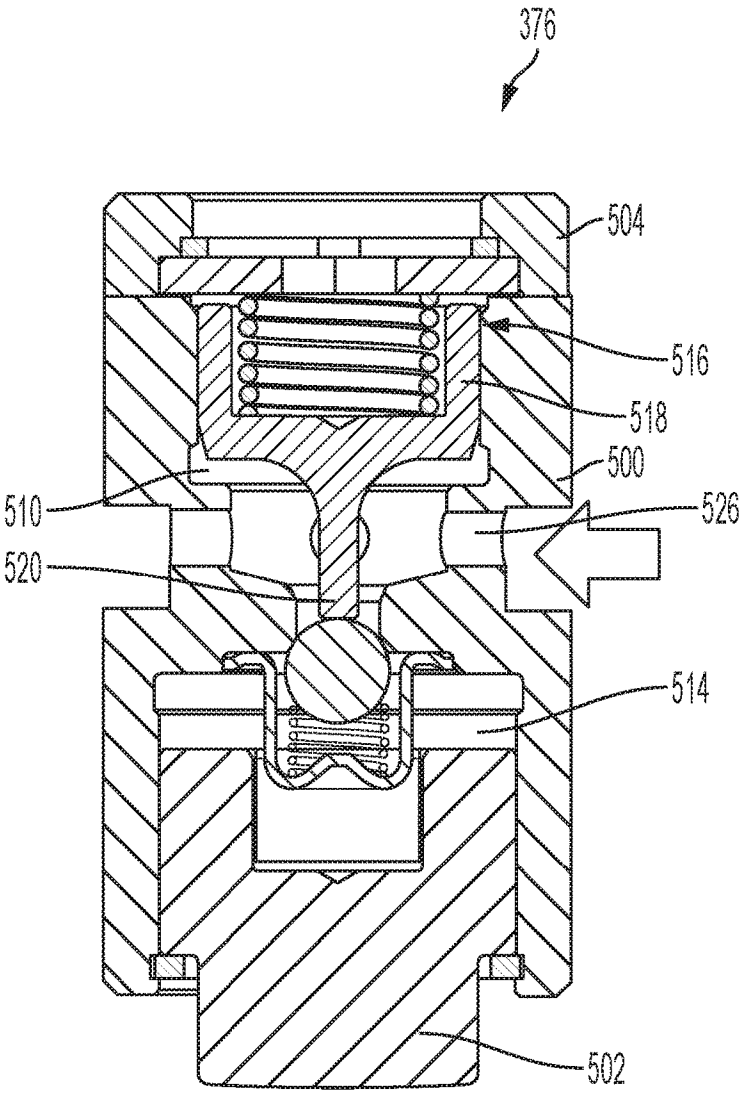
FIG. 16 is a cross-sectional view of an engine brake capsule shown in FIG. 14.
Figure 15:
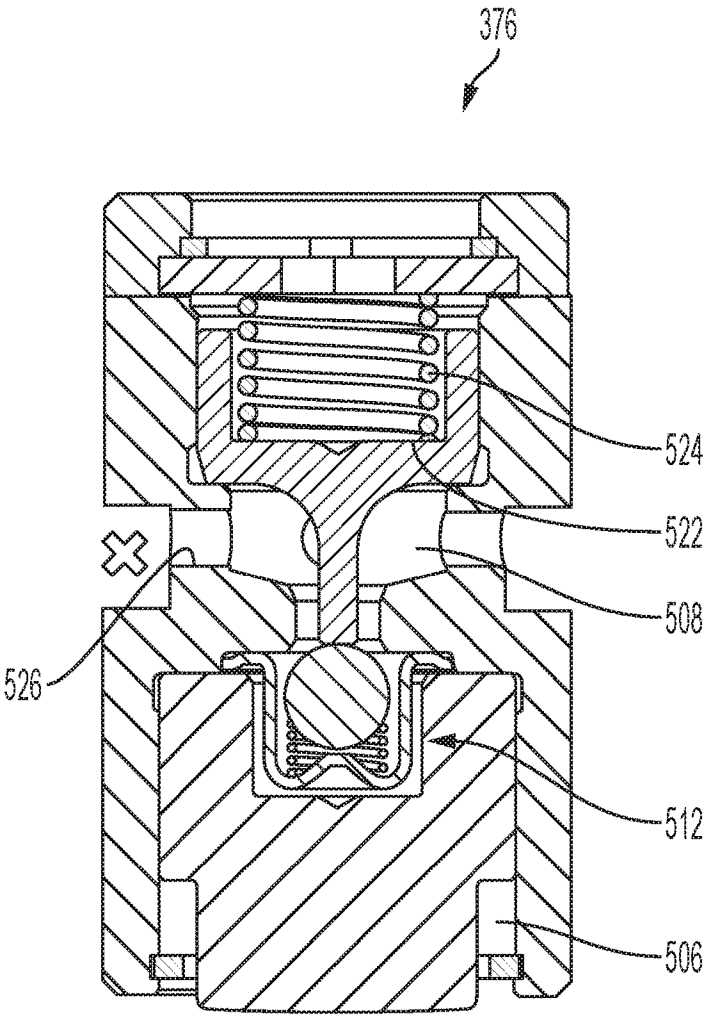
FIG. 15 is a cross-sectional view of an engine brake capsule shown in FIG. 13.

With further reference to FIGS. 15 and 16, the actuator or engine brake capsule 376 can generally include an outer housing 500, a plunger 502, and a cap 504. The outer housing 500 can be received by the bore 380 of the rocker arm 370 and can generally include a lower chamber 506, an intermediate chamber 508, and an upper chamber 510. The plunger 502 is slidably received within lower chamber 506 and is configured to act against the valve bridge assembly 332.

A check ball assembly 512 can be disposed in the lower chamber 506. The check ball assembly 512 can be configured to hold oil within a space or area 514 between the plunger 502 and the intermediate chamber 508. A pin assembly 516 is disposed in the upper chamber 510 and includes a main body 518 and a pin arm 520. The main body 518 defines a seat 522 configured to receive a biasing mechanism 524 (e.g., a spring), and pin arm 520 extends downwardly from the main body into the intermediate chamber 508. The biasing mechanism 524 is configured to rest against the cap 504 and bias the pin assembly 516 downward into contact with the check ball assembly 512.

Oil can be supplied to the intermediate chamber 508 via, for example, the rocker shaft 322 and through ports 526. The upward pressure of the fluid supply compresses the biasing mechanism 524 such that pin assembly 516 is moved away from the check ball assembly 512. This movement allows the oil in intermediate chamber 508 to fill area 514 and move plunger 502 downward and outward into an extended position to engage the valve bridge assembly 332 (e.g., a brake mode). When the supply of oil ceases, the oil in intermediate chamber 508 can be at least partially evacuated and plunger 502 is able to slide upward into lower chamber 506 when the plunger 502 comes into contact with the valve bridge assembly 332 (e.g., drive mode).

Thus, the engine brake capsule 376 can be selectively operated between the brake mode (FIGS. 14 and 16) and the drive mode (FIGS. 13 and 15). In the brake mode, pressurized oil is selectively supplied to ports 526 to move the plunger downward into the extended position. In the drive mode, the oil supply to ports 526 is suspended, and the plunger 502 returns to the retracted position within the lower chamber 506 of outer housing 500.

Figure 17:
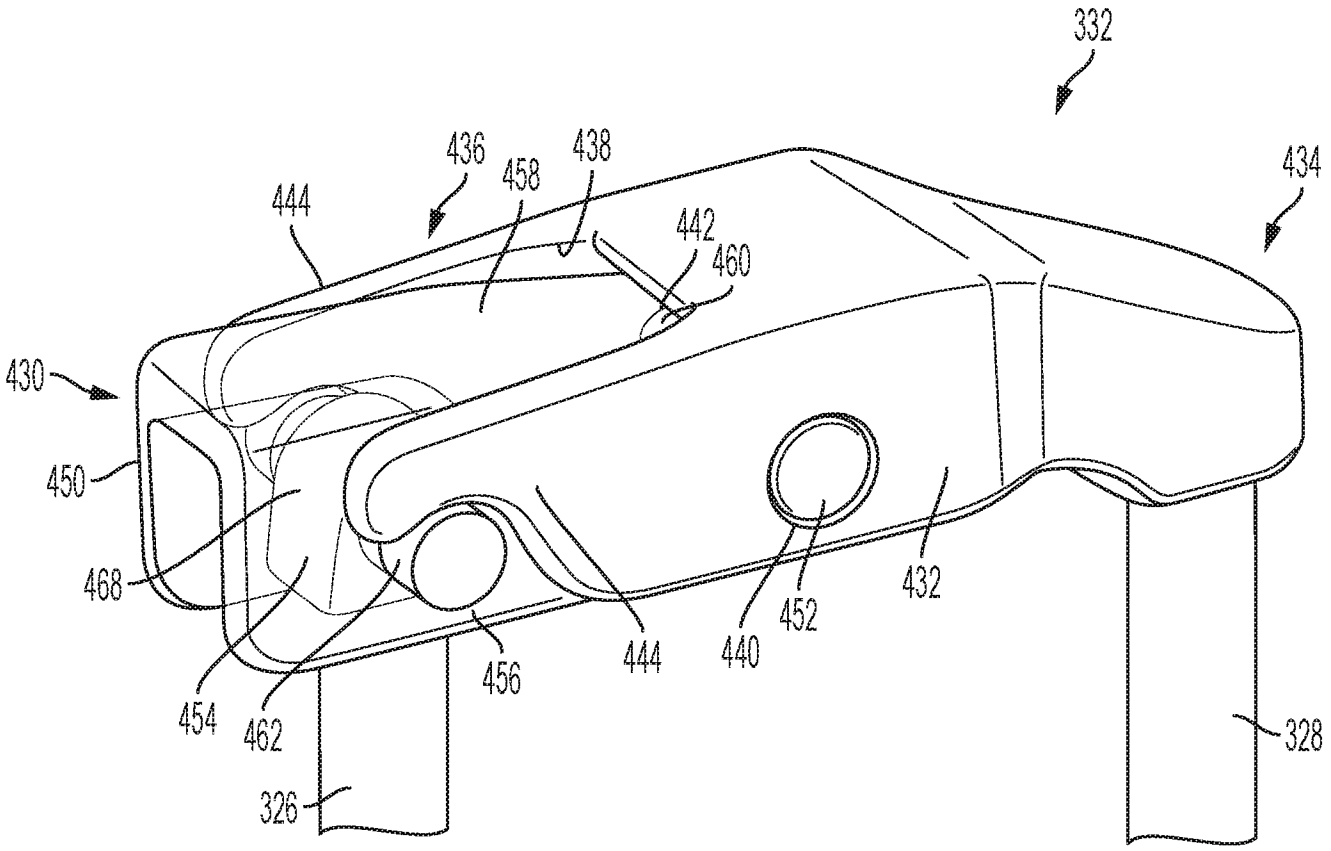
FIG. 17 is a perspective view of an example valve bridge assembly shown in FIG. 12

With additional reference to FIG. 17, valve train assembly 300 includes valve bridge assembly 332 to overcome the potentially undesirable events described above in relation to conventional valve bridges. In the example embodiment, valve bridge assembly 332 includes a movable lever assembly 430 integrated therein that can pass some of the valve actuation force back to HLA assembly 336 (via bridge 332), thereby preventing unintended extension of the HLA during the braking event. Thus, lever assembly 330 allows the valve 326 to open during the engine braking operation without allowing downward motion of the valve bridge assembly 332. Moreover, lever assembly 430 significantly reduces the actuation force required for the braking event compared to known systems.

In the illustrated example, the valve bridge assembly 332 comprises the lever assembly 430 disposed within a bridge main body 432. The bridge main body 432 includes a first end 434 and a second end 436. The first end 434 can be configured to engage valve 328, and the second end 436 can include a cutout 438 and opposed apertures 440 and 442.

As shown in FIG. 17, the lever assembly 430 can generally include a lever 450, a bridge pin 452, a valve shoe 454, and a valve shoe pin 456. The lever 450 can be disposed at least partially within the cutout 438 and is rotatably coupled to and within the bridge main body 432 by the bridge pin 452, which extends through the opposed apertures 440, 442 of the bridge main body 432. Moreover, the lever 450 can be disposed between opposed flanges 444 of the bridge main body 432.

The lever 450 includes an engagement surface 458, first opposed openings 460, and second opposed openings 462. The engagement surface 458 is configured to be selectively engaged by plunger 502 of piston assembly 376. First opposed openings 460 can receive the bridge pin 452, and the second opposed openings 462 can receive the valve shoe pin 456.

The valve shoe 454 includes a main body portion 468 having an aperture 472 formed therein. The main body portion 468 is configured to receive a portion of the valve 326, and also receive the valve shoe pin 456 to rotatably couple the valve shoe 454 to the lever 450.

Figure 18:
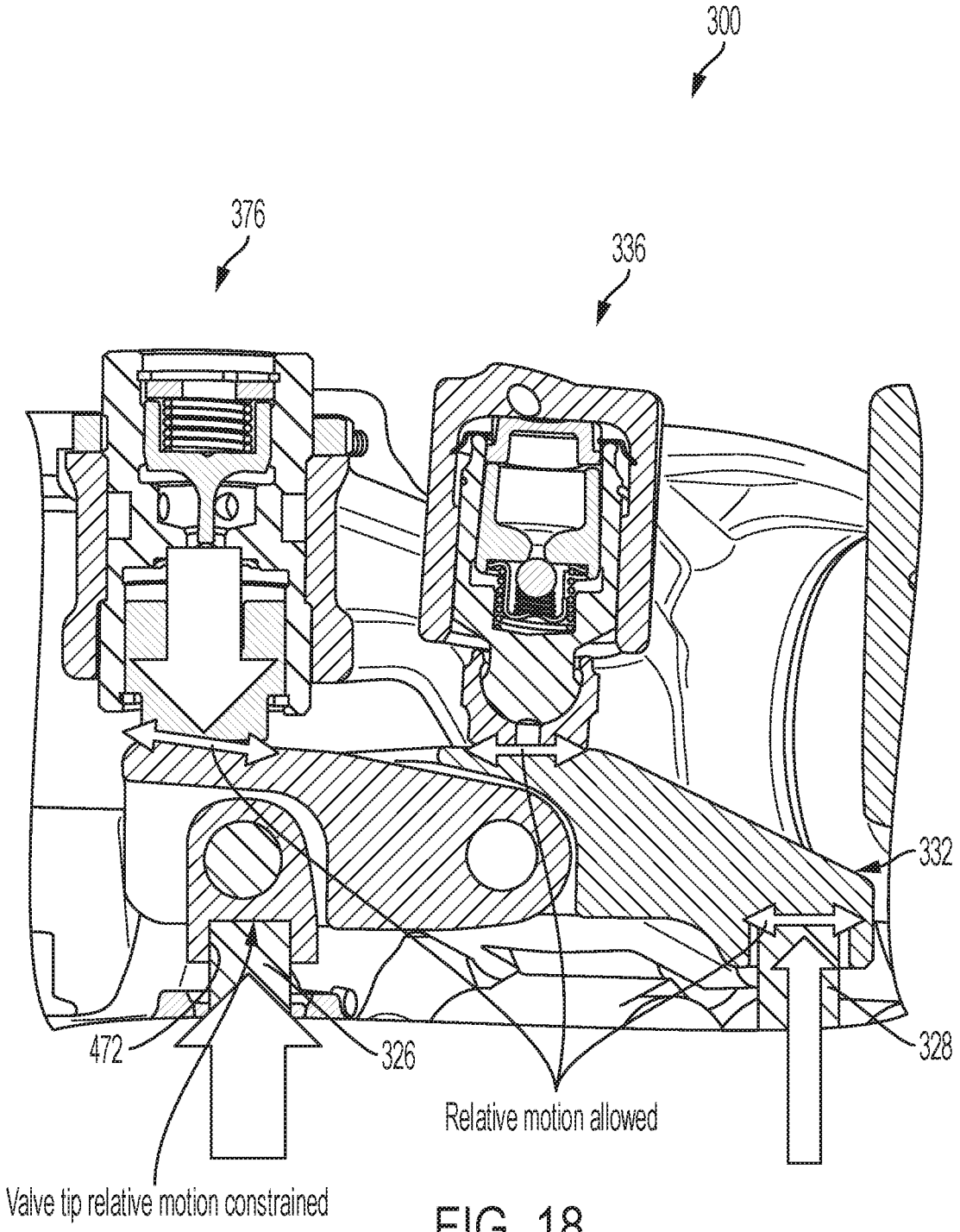
FIG. 18 is a sectional view of the valve train assembly shown in FIG. 12 with one example valve bridge assembly.
Figure 19:
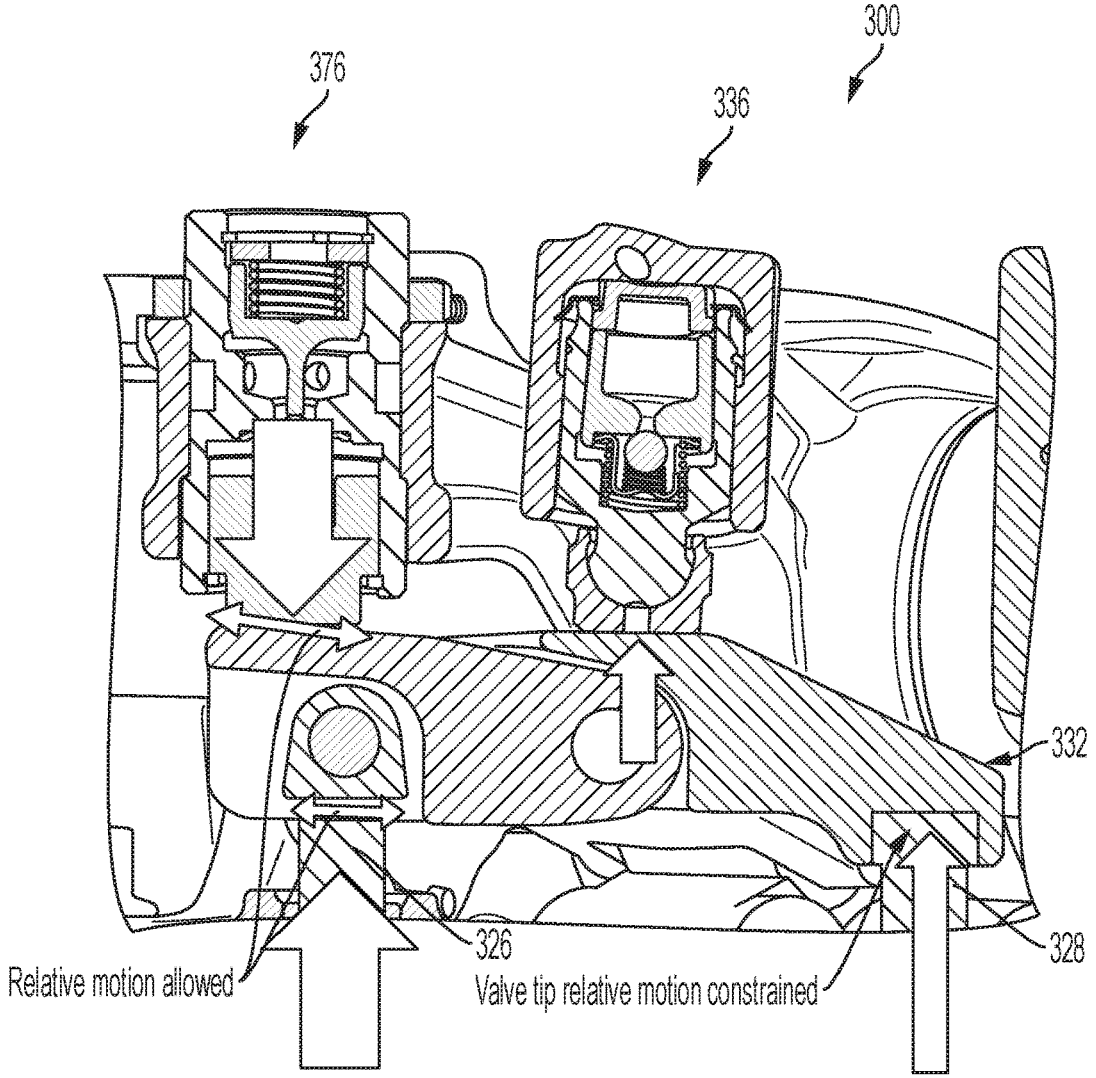
FIG. 19 is a sectional view of the valve train assembly shown in FIG. 12 with another example valve bridge assembly.

Accordingly, lever 450 can be selectively engaged at the engagement surface 458, which can cause rotation about pin 456 and upward movement of an opposed side 474 of the lever that is opposite surface 458 (see FIGS. 18 and 19). This upward movement of lever end 474 causes upward movement of bridge main body 432 toward HLA assembly 336 to prevent extension thereof.

As such, during operation of rocker arm assembly 320, the exhaust rocker arm assembly 316 can selectively engage the valve bridge main body 432 to actuate valves 326, 328 and perform a normal exhaust event (combustion mode); whereas, the engine brake rocker arm assembly 318 can selectively engage the lever assembly 430 to only actuate valve 326 and perform a brake event actuation (engine braking mode).

The engine brake capsule 376 is configured to move the plunger 502 between the retracted position and the extended position. In the retracted position, the plunger 502 is withdrawn into the outer housing lower chamber 504 such that the plunger 502 is spaced apart from and does not contact the lever engagement surface 458 even when the cam lobe (e.g., lobe 84) of camshaft 324 engages the engine brake rocker arm 370.

However, in the extended position, the plunger 502 extends from the outer housing lower chamber 502 such that plunger 502 is positioned to engage the lever engagement surface 458. When the cam lobe engages the engine brake rocker arm 370, plunger 502 rotates the lever 450 about pin 456 to engage the valve 326 and perform the brake event actuation. FIGS. 14 and 16 show engine brake capsule 376 in the extended position as a result of oil being supplied through ports 526. In this position, engine brake event actuation is active, and engine brake capsule 376 is configured to engage the lever assembly 430 of the valve bridge assembly 332. The engine brake event actuation capability may be deactivated by ceasing the oil supply through ports 526, thereby causing the engine brake capsule 376 to move to the retracted position.

In one example embodiment, shown in FIG. 18, valve tip motion of valve 326 can be constrained (e.g., tight tolerance or interference fit) within valve shoe 454. As such, during braking operation, the pivot arm will create relative motion between the valve 326 and valve bridge assembly 332. In this arrangement, the brake valve 326 is constrained and relative motion is transferred to the HLA 336 and valve 328.

In another example embodiment, shown in FIG. 19, valve tip motion of valve 328 can be constrained within the valve bridge main body 432. As such, during braking operation, the brake valve 328 is constrained and relative motion is transferred to the HLA 336 and valve 326.

While the systems described above are shown and discussed as utilized with exhaust engine valves, it will be appreciated that such systems may be utilized with various other engine valves including intake valves. Moreover, the described systems may be utilized to accomplish various engine control techniques including Variable Valve Lift (VVL), Early Intake Valve Opening (EIVO), Early Intake Valve Closing (EIVC), Late Intake Valve Opening (LIVO), Late Intake Valve Closing (LIVC), Early Exhaust Valve Opening (EEVO), Early Exhaust Valve Closing (EEVC), Late Exhaust Valve Opening (LEVO), Late Exhaust Valve Closing (LEVC), a combination of EEVC and LIVO, Negative Valve Overlap (NVO), internal exhaust gas recirculation (IEGR), or other engine control techniques.

Figure 20:
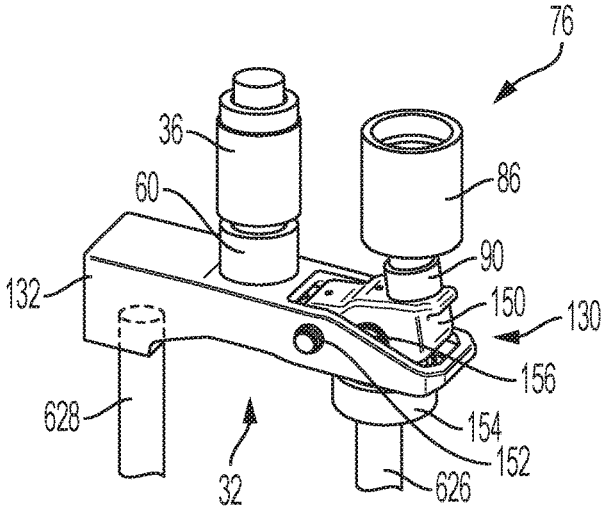
FIG. 20 is a perspective view of a rocker arm assembly constructed in accordance to another example of the present disclosure.

For example, as shown in FIG. 20, valve bridge assembly 32, HLA assembly 36, and actuator 76 are shown operably associated with first and second intake valves 626 and 628. The HLA assembly 36 is coupled to a first intake rocker arm of a first intake rocker arm assembly (not shown), and the actuator 76 is coupled to a second intake rocker arm of a second intake rocker arm assembly (not shown). Such an arrangement can look similar to that illustrated in FIG. 2, just arranged with intake rocker arm assemblies (instead of exhaust and brake rocker arm assemblies) operably associated with the valve bridge assembly 32 and intake valves 626 and 628.

During operation, the first intake rocker arm assembly can selectively engage the valve bridge main body 132 to actuate valves 626, 628 and perform a normal intake event (combustion mode); whereas, the second intake rocker arm assembly can selectively engage the lever assembly 130 to only actuate valve 626 and perform a late intake valve closing (LIVC mode).

Further, in some embodiments, intake valve rocker arm assembly 14 (e.g., the first intake rocker arm assembly) and/or exhaust valve rocker arm assembly 16 can be equipped with cylinder deactivation (CDA), for example, such as that described in commonly owned, co-pending patent application no. PCT/EP2019/025176 filed Jun. 11, 2019, and PCT/EP2019/025043 filed Feb. 14, 2019, the contents of which are incorporated herein in their entirety by reference thereto. In this way, an exhaust or intake rocker arm can include a CDA capsule (not shown) configured to directly engage the valve bridge assembly 32 or be in-line with HLA assembly 36. The CDA capsule is configured to selectively move between a latched or activated position and an unlatched or deactivated position, for example, via a supply of pressurized fluid. However, the CDA capsule may be moved between the activated and deactivated positions by and suitable means such as, for example, mechanical, pneumatic, electrical, etc.

In the activated position, pressurized fluid is supplied (e.g., via oil control valve) to the CDA capsule, which subsequently acts as a unitary body and transfers motion from the rocker arm to the exhaust valves 26, 28 or intake exhaust valves 626, 628 via the valve bridge assembly 32. In contrast, when the CDA capsule is in the deactivated position, pressurized fluid supply is ceased to the CDA capsule, and downward movement of the rocker arm causes the CDA capsule to and absorb the downward motion without transferring said motion to the valve bridge assembly 32 or engine valves 26, 28, 626, 628. In alternative configurations, supplying the pressurized fluid moves the CDA capsule to the deactivated position, and ceasing supply of the pressurized fluid moves the CDA capsule to the activated position.

Figure 21:
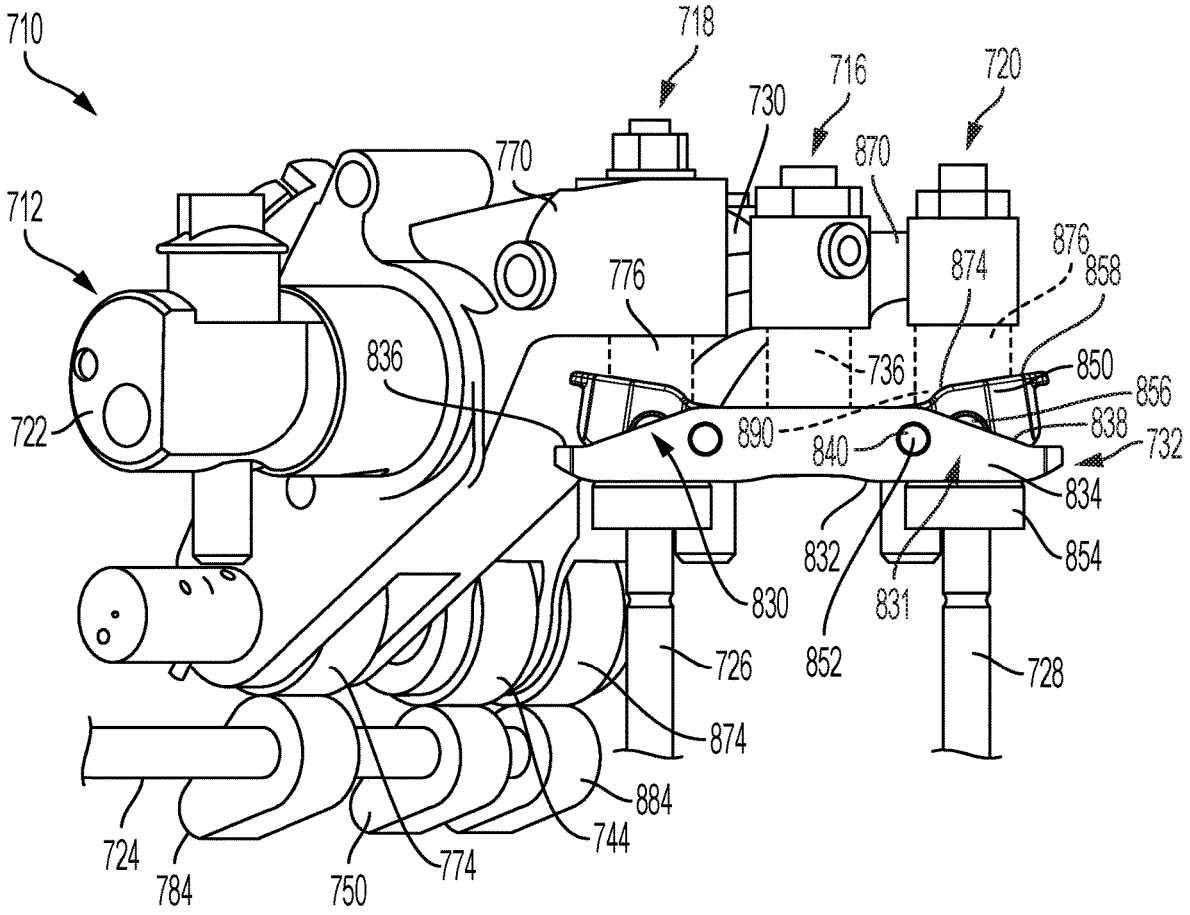
FIG. 21 is a perspective view of a valve train assembly constructed in accordance to another example of the present disclosure.

Turning now to FIG. 21, a partial valve train assembly constructed in accordance with another example of the present disclosure is shown and generally identified at reference 710. The partial valve train assembly 710 is similar to partial valve train assembly 10, but provides functionality in addition to engine braking. In the example embodiment, the additional functionality includes IEGR and EEVO. However, it will be appreciated that partial valve train assembly 710 may be utilized to provide other operations.

The partial valve train assembly 710 is supported in a valve train carrier 712 and can include four rocker arms per cylinder. Specifically, each cylinder includes an intake valve rocker arm assembly (not shown), an exhaust valve rocker arm assembly 716, an engine brake rocker arm assembly 718, and a third or added function rocker arm assembly 720. The exhaust valve rocker arm assembly 716, the engine brake rocker arm assembly 718, and the added function rocker arm assembly 720 cooperate to control opening of exhaust valves. The intake valve rocker arm assembly is configured to control motion of the intake valves, however, it will be appreciated that the described three rocker arm configuration may be alternatively or additionally utilized for the intake valve rocker arm assembly. The exhaust valve rocker arm assembly 716 is configured to control exhaust valve motion in a drive mode, the engine brake rocker arm assembly 718 is configured to act on one of the two exhaust valves in an engine brake mode, and the added function rocker arm assembly 720 is configured to act on one of the two exhaust valves in an added function mode (e.g., IEGR mode, EEVO mode), as will be described herein.

A rocker shaft 722 is received by the valve train carrier 712 and supports rotation of the rocker arm assemblies 716, 718, 720. The rocker shaft 722 can communicate oil to the assemblies 716, 718, 720 during operation, and a cam shaft 724 includes lift profiles or cam lobes configured to rotate assemblies 716, 718, 720 to activate first and second exhaust valves 726 and 728, as is described herein in more detail.

In the example embodiment, the exhaust valve rocker arm assembly 716 includes an exhaust rocker arm 730, a valve bridge assembly 732, and an HLA assembly 736. The exhaust rocker arm 730 can be the same or similar to the exhaust valve rocker arm 30 described herein and is configured to be engaged by a cam lobe 750 of the cam shaft 724. As such, when roller 744 is engaged by the exhaust lift profile 750, the exhaust rocker arm 730 is rotated downward, causing downward movement of the valve bridge assembly 732, which engages the first and second exhaust valves 726 and 728 associated with a cylinder of an engine (not shown). The HLA assembly 736 can be the same or similar to the HLA assembly 36 described herein. The engine brake rocker arm assembly 718 can be the same or similar to the engine brake rocker arm assembly 18 described herein and is configured to be engaged by a cam lobe 784. As such, when roller 774 is engaged by the cam lobe 784, a brake rocker arm 770 is rotated downward, causing downward movement of a piston assembly 776, which can be the same or similar to the described piston assembly 76.

The added function rocker arm assembly 720 can be similar to the engine brake rocker arm assembly 718 and can generally include an added function rocker arm 870, an axle (not shown), a roller 874, an actuator or piston assembly 876, and a check valve assembly (not shown). Added function rocker arm 870 can receive the rocker shaft 722 and can define a first bore (not shown) configured to at least partially receive the piston assembly 876, and a second bore (not shown) configured to at least partially receive the check valve assembly. The axle can be coupled to the rocker arm 870 and can receive the roller 874, which is configured to be engaged by a brake lift profile or cam lobe 884 of the cam shaft 724. As such, when the roller 874 is engaged by the cam lobe 884, the brake rocker arm 870 is rotated downward, causing downward movement of the piston assembly 876, which can be the same or similar to the piston assembly 76 described herein. The check valve assembly can be the same or similar to the check valve assembly 78 described herein.

In the example embodiment, the valve bridge assembly 732 is similar to valve bridge assembly 32 except it includes a second movable lever assembly 831 integrated on the second end of the bridge main body. The second movable lever assembly 831 can pass some of the valve actuation force back to the HLA assembly 736 (via bridge 732), thereby preventing unintended extension of the HLA assembly during the added function mode. Thus, second lever assembly 831 allows the valve 728 to open during the added function mode without allowing downward motion of the valve bridge assembly 732.

As illustrated, the valve bridge assembly 732 includes a first lever assembly 830 and the second lever assembly 831 disposed within a bridge main body 832. The lever assemblies 830, 831 are the same or similar to the lever assembly 130 described herein. The bridge main body 832 includes a first end 834 and a second end 836. The first end 834 can include a first aperture 838, a second aperture 840, and a third aperture (not shown).

Similar to lever assembly 130, the second lever assembly 831 can generally include a lever 850, a bridge pin 852, a valve shoe 854, and a valve shoe pin 856. The lever 850 can be disposed within (e.g., nested within) the first aperture 838 and is rotatably coupled to the bridge main body 832 by the bridge pin 852, which extends through the second and third apertures of the bridge main body 832. The lever 850 includes an engagement surface 858 configured to be selectively engaged by a socket 890 of piston assembly 876. In one example, the added function rocker arm 870 is coupled to the lever 850, for example, via the piston assembly 876 or socket 890, to maintain constant contact therebetween for dynamic stability to thereby prevent lever flutter (e.g., oscillation, vibration, etc.). The lever 850 can be selectively engaged at the engagement surface 858, which causes rotation and upward movement of the opposed side 874 of the lever that is opposite surface 858. This upward movement of the opposite lever end 874 causes upward movement of the bridge main body 832 toward HLA assembly 736 to prevent extension thereof.

As such, during operation, the exhaust rocker arm assembly 716 can selectively engage the valve bridge main body 832 to actuate valves 726, 728 and perform a normal exhaust event (combustion mode), the engine brake rocker arm assembly 718 can selectively engage the first lever assembly 830 to only actuate valve 726 and perform a brake event actuation (engine braking mode), and the added function rocker arm assembly 720 can selectively engage the second lever assembly 831 to only actuate valve 728 and perform an added function event actuation such as, for example, an IEGR actuation (IEGR mode) or an EEVO actuation (EEVO mode).

In the example embodiment, the piston assembly 876 is configured to move between a retracted position and an extended position. In the retracted position, the socket 890 is spaced apart from and does not contact the lever engagement surface 858 even when the cam lobe 884 of camshaft 724 engages the added function rocker arm 870. However, in the extended position, the socket 890 is positioned to engage the lever engagement surface 858. When the cam lobe 884 of camshaft 724 engages the added function rocker arm 870, socket 890 rotates the lever 850 to engage the valve 728 and perform the added function event actuation. The piston assembly 876 can be moved to the extended position as a result of oil being supplied from rocker shaft 722 through a channel (not shown). The added function capability may be deactivated by ceasing the oil supply through the channel, thereby causing the piston assembly 876 to move to the retracted position.

During operation, rocker arm assemblies 716 and 718 function as described for rocker arm assemblies 16 and 18. During an added function event actuation (e.g., IEGR or EEVO), the added function rocker arm 870 is engaged by the cam lobe 884 of cam shaft 724. In particular, as cam shaft 724 rotates, cam lobe 884 engages roller 874, which causes the rocker arm 870 to rotate about the rocker shaft 722. When the piston assembly 876 is in the extended position, the added function rocker arm 870 pushes socket 890 downward to engage and cause downward movement of lever engagement surface 858. This in turn can cause downward movement of the valve shoe 854, which opens valve 728. Further, as lever 850 pivots, the opposite lever end 874 moves upward against bridge main body 732, which pushes against the HLA assembly 736 to prevent extension thereof during the added function event.

Described herein are systems and methods for braking an engine. The system includes an exhaust valve rocker arm that engages a valve bridge to actuate two valves to perform an exhaust event. In one aspect, the valve bridge includes a main body and a lever integrated therein, the internal lever being rotatable relative to a valve bridge main body. The rotatable lever can be selectively engaged and rotated by an engine brake rocker arm to actuate one of the two valves to perform an engine brake event.

Moreover, the lever can simultaneously pass some of the valve actuation force back to the HLA assembly, thereby preventing unintended extension of the HLA assembly during the braking event. Thus, the internal lever allows the valve to open during the engine braking operation without cocking or rotating the main body, which can cause the unintended extension. Additionally, lever assembly significantly reduces the actuation force required for the braking event compared to known systems. In another aspect, the valve bridge can include a hydraulic actuator assembly, which utilizes a hydraulic intensifier to multiply load (reduce stroke), while transferring some of the load to the bridge and the HLA. In other aspects, the rocker arm assembly may be utilized on intake valves, include a second lever assembly, and provide added function to the rocker arm assembly such as CDA, IEGR, LIVC, and EEVO.

The foregoing description of the examples has been provided for purposes of illustration and description. It is not intended to be exhaustive or to limit the disclosure. Individual elements or features of a particular example are generally not limited to that particular example, but, where applicable, are interchangeable and can be used in a selected example, even if not specifically shown or described. The same may also be varied in many ways. Such variations are not to be regarded as a departure from the disclosure, and all such modifications are intended to be included within the scope of the disclosure.

What is claimed is:

1. An exhaust valve rocker arm assembly selectively opening first and second exhaust valves and comprising:

an exhaust rocker arm;

a valve bridge operably associated with the rocker arm and including a main body and a lever rotatably coupled to the main body, the main body configured to engage the first exhaust valve, and the lever configured to engage the second exhaust valve; and a brake rocker arm configured to selectively engage and rotate the lever to open the second exhaust valve, wherein the brake rocker arm is coupled to the lever and configured to maintain constant contact therewith for dynamic stability.

2. The assembly of claim 1, wherein the brake rocker arm includes an actuator coupled to the lever to maintain the constant contact therewith.

3. The assembly of claim 2, wherein the actuator includes a socket, wherein the socket is coupled to the lever to maintain the constant contact therewith.

4. The assembly of claim 3, wherein the actuator is a piston assembly.

5. The assembly of claim 3, wherein the actuator is a brake capsule assembly.

6. The assembly of claim 1, wherein the lever is coupled to the main body such that rotation of the lever and engagement of the second exhaust valve occurs without rotation of the main body.

7. The assembly of claim 1, wherein the main body includes an aperture, the lever at least partially disposed within the aperture.

8. The assembly of claim 7, wherein the lever is rotatably coupled to the main body by a bridge pin extending through the main body.

9. The assembly of claim 1, wherein the lever includes an engagement surface, an opposed side opposite the engagement surface, and a stop flange extending therefrom, wherein the engagement surface is configured to be engaged by an engine brake rocker arm, the opposed side is configured to move upwardly against the main body when the engagement surface is moved downward, and wherein the stop flange is configured to selectively engage an edge of the main body that at least partially defines the aperture to limit downward movement of the lever.

10. The assembly of claim 1, further comprising a valve shoe rotatably coupled to the lever, the valve shoe configured to engage the second exhaust valve.

11. The assembly of claim 10, wherein the valve shoe is rotatably coupled to the lever by a valve shoe pin extending through the lever.

12. The assembly of claim 1, further comprising a hydraulic lash adjuster assembly coupled between the exhaust rocker arm and the valve bridge.

13. The assembly of claim 2, wherein the actuator assembly is movable between a retracted position and an extended position.

14. The assembly of claim 13, wherein the actuator assembly includes a first piston body, a second piston body disposed within the first piston body, and a socket coupled between the first piston body and the lever, the socket configured to engage the lever.

15. The assembly of claim 14, further comprising:

a hydraulic lash adjuster assembly coupled between the exhaust rocker arm and the valve bridge; and a cylinder deactivation (CDA) capsule disposed in the exhaust rocker arm and configured to move between an activated position and a deactivated position.

16. An exhaust valve rocker arm assembly selectively opening first and second exhaust valves and comprising:

an exhaust rocker arm;

a valve bridge operably associated with the rocker arm and including a main body and a lever rotatably coupled to the main body, the main body configured to engage the first exhaust valve, and the lever configured to engage the second exhaust valve; and an engine brake rocker arm configured to selectively rotate the lever to open the second exhaust valve, wherein the engine brake rocker arm includes a socket coupled to the lever to maintain constant contact for dynamic stability.

17. An exhaust valve rocker arm assembly selectively opening first and second exhaust valves and comprising:

an exhaust rocker arm; and a valve bridge operably associated with the rocker arm and including a main body and a lever rotatably coupled to the main body, the main body configured to engage the first exhaust valve, and the lever configured to engage the second exhaust valve; and a hydraulic lash adjuster (HLA) assembly coupled between the exhaust rocker arm and the valve bridge, wherein the exhaust rocker arm contacts the main body and defines a central point of contact, and the main body defines an axial length, and wherein the lever is rotatably coupled to the main body at a pivot point, which is located at a predetermined distance from the central point of contact along the main body axial length, the predetermined distance determined by at least one of forces on the exhaust rocker arm and the HLA assembly.

18. The assembly of claim 17, further comprising an engine brake rocker arm assembly having an engine brake rocker arm configured to selectively engage and rotate the lever to open the second exhaust valve, wherein the predetermined distance is determined by at least one of forces on the exhaust rocker arm, the HLA assembly, and the engine brake rocker arm.

* * * * *